US008383570B2

(12) United States Patent
Kieffer et al.

(10) Patent No.: US 8,383,570 B2
(45) **Date of Patent: *Feb. 26, 2013**

(54) ENHANCED MELTING POINT RINSE AID SOLID COMPOSITIONS WITH SYNERGISTIC PRESERVATIVE

(75) Inventors: Janel Marie Kieffer, Hastings, MN (US); Victor Fuk-Pong Man, St. Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/480,121

(22) Filed: May 24, 2012

(65) Prior Publication Data

US 2012/0245074 A1 Sep. 27, 2012

Related U.S. Application Data

(63) Continuation-in-part of application No. 13/008,606, filed on Jan. 18, 2011, now abandoned, which is a continuation-in-part of application No. 12/425,644, filed on Apr. 17, 2009, now Pat. No. 7,883,584, which is a continuation of application No. 11/754,177, filed on May 25, 2007, now Pat. No. 7,521,412.

(51) Int. Cl.
*C11D 7/08* (2006.01)
*C11D 3/34* (2006.01)
*C11D 3/26* (2006.01)

(52) U.S. Cl. ..... 510/445; 510/197; 510/457; 510/475; 510/492; 510/501; 510/524

(58) Field of Classification Search ..... 510/197, 510/445, 457, 475, 492, 501, 524
See application file for complete search history.

(56) References Cited

U.S. PATENT DOCUMENTS

| | | | |
|---|---|---|---|
| 4,426,362 | A | 1/1984 | Copeland et al. |
| 4,492,646 | A | 1/1985 | Welch |
| 4,618,914 | A | 10/1986 | Sato et al. |
| 4,647,258 | A | 3/1987 | Massarsch |
| 4,654,161 | A | 3/1987 | Kollmeier et al. |
| 4,687,121 | A | 8/1987 | Copeland |
| 4,690,305 | A | 9/1987 | Copeland |
| RE32,763 | E | 10/1988 | Fernholtz et al. |
| RE32,818 | E | 1/1989 | Fernholz et al. |
| 4,826,661 | A | 5/1989 | Copeland et al. |
| 4,830,773 | A | 5/1989 | Olson |
| 5,273,677 | A | 12/1993 | Arif |
| 5,358,653 | A | 10/1994 | Gladfelter et al. |
| 5,397,506 | A | 3/1995 | Groth et al. |
| 5,474,698 | A | 12/1995 | Rolando et al. |
| 5,501,815 | A | 3/1996 | Man |
| 5,589,099 | A | 12/1996 | Baum |
| 5,603,776 | A | 2/1997 | Lentsch et al. |
| 5,674,831 | A | 10/1997 | Schulz et al. |
| 5,876,514 | A | 3/1999 | Rolando et al. |
| 5,880,088 | A | 3/1999 | Lentsch et al. |
| 5,880,089 | A | 3/1999 | Lentsch et al. |
| H1818 | H | 11/1999 | Potgieter et al. |
| 6,258,765 | B1 | 7/2001 | Wei et al. |
| 6,294,515 | B1 | 9/2001 | Baum |
| 6,530,383 | B1 | 3/2003 | Rogmann et al. |
| 6,537,961 | B1 | 3/2003 | Koch |
| RE38,262 | E | 10/2003 | Rolando et al. |
| 6,956,019 | B2 | 10/2005 | Lentsch et al. |
| 7,279,455 | B2 | 10/2007 | Kieffer et al. |
| 7,521,412 | B2 * | 4/2009 | Kieffer et al. ..... 510/445 |
| 7,592,301 | B2 | 9/2009 | Smith et al. |
| 2003/0109403 | A1 | 6/2003 | Man et al. |
| 2003/0166494 | A1 | 9/2003 | Man et al. |
| 2004/0110657 | A1 | 6/2004 | Strothoff |
| 2004/0157760 | A1 | 8/2004 | Man et al. |
| 2005/0101516 | A1 | 5/2005 | Kieffer et al. |
| 2005/0130865 | A1 | 6/2005 | Schmid et al. |
| 2005/0143280 | A1 | 6/2005 | Nelson et al. |
| 2006/0058209 | A1 | 3/2006 | Lentsch et al. |
| 2006/0189508 | A1 | 8/2006 | Brooker et al. |
| 2007/0253926 | A1 | 11/2007 | Tadrowski et al. |
| 2008/0293615 | A1 | 11/2008 | Kieffer et al. |
| 2009/0196897 | A1 | 8/2009 | Gladfelter et al. |
| 2010/0009886 | A1 | 1/2010 | Smith et al. |
| 2010/0300044 | A1 | 12/2010 | Man et al. |

FOREIGN PATENT DOCUMENTS

| | | | |
|---|---|---|---|
| DE | 69918694 | T2 | 7/2005 |
| EP | 1102834 | B1 | 5/2001 |
| JP | 2009111294 | | 5/2009 |
| WO | WO 89/11525 | | 11/1989 |
| WO | WO 00/08125 | A1 | 2/2000 |
| WO | WO 00/46327 | | 8/2000 |
| WO | WO 01/83879 | A1 | 11/2001 |
| WO | WO 2005/085321 | A1 | 9/2005 |

OTHER PUBLICATIONS

BASF Corporation Technical Bulletin, "Plurafac LF-221 Alcohol Alkoxylate", 2002 BASF Corporation, Mount Olive, New Jersey (1 page).

DOW Personal Care, "Kathon CG, A Safe, Effective, Globally Approved Preservative for Rinse-Off Products", Rohm and Haas, 2007 (9 pages).

* cited by examiner

*Primary Examiner* — Brian P Mruk
(74) *Attorney, Agent, or Firm* — McKee, Voorhees & Sease, P.L.C.

(57) ABSTRACT

The invention includes a GRAS preservative system including sodium bisulfate and a combination of specific organic acids that act in a synergistic capacity. The preservative further has the benefit of a higher melting point of approximately 110° or higher making it particularly suited for solid wash applications. According to the invention it has surprisingly been found that a combination of sodium bisulfate, sorbic acid, and benzoic acid produced better preservative properties than other organic acid combinations or each acid by itself.

20 Claims, No Drawings

ENHANCED MELTING POINT RINSE AID SOLID COMPOSITIONS WITH SYNERGISTIC PRESERVATIVE

CROSS-REFERENCE TO RELATED APPLICATIONS

This application is a Continuation-in-part Application of U.S. Ser. No. 13/008,606 filed Jan. 18, 2011, now abandoned which is a Continuation-in-part Application of U.S. Ser. No. 12/425,644 filed Apr. 17, 2009, now U.S. Pat. No. 7,883,584 issued on Feb. 8, 2011, which is a Continuation Application of U.S. Ser. No. 11/754,177 filed May 25, 2007, now U.S. Pat. No. 7,521,412 issued on Apr. 21, 2009; herein incorporated by reference in their entirety.

BACKGROUND OF THE INVENTION

Most cosmetic, personal care, and detergent compositions e.g. shampoos, bath foams, skin creams, washing-up liquid, laundry detergents, ware wash detergents, rinse aids, hard surface cleaners and the like are susceptible to microbial spoilage. Such spoilage cannot only compromise the performance of the product but also, in extreme cases, present a health hazard to users of the product. Manufacturers of such products take stringent precautions to prevent microbial contamination of their products during manufacture and distribution. Once the product package has been opened however, the contents may be open to inadvertent contamination by the user or e.g. through airborne spores.

It is customary, therefore, to add a preservative to such products at the time of manufacturing in order to protect the product against microbial contamination in the long term. A wide variety of such preservatives are known and used. The precise choice of type and level of the preservative is usually made by the formulator based upon a number of factors including, for example, the microbiological requirements of the product, cost, the pH of the product, compatibility with the other formulation ingredients and regulatory restrictions.

An effective preservative is one which prevents the multiplication of any bacteria, mold, yeast or fungi i.e. possessing either or both biocidal and biostatic effects, over a product storage lifetime and while in use. Many factors influence product preservation among which are: the specific product composition, its pH, hygiene during manufacture; its manner of use, expected life in use, and the frequency and severity of organism inoculation in use which is influenced by the type of packaging and storage temperature.

Mechanical warewashing machines have been common in the institutional and household environments for many years. Such automatic warewashing machines clean dishes using two or more cycles which can include initially a wash cycle followed by a rinse cycle, but may also utilize soak, pre-wash, scrape, sanitizing, drying, and additional wash cycles. Rinse agents are conventionally used in warewashing applications to promote drying and to prevent the formation of spots.

In order to reduce the formation of spotting, rinse agents have commonly been added to water to form an aqueous rinse that is sprayed on the dishware after cleaning is complete. The precise mechanism through which rinse agents work is not established. One theory holds that the surfactant in the rinse agent is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and, according to this theory, would not promote sheet formation, thereby resulting in spots. Moreover, high foaming materials are known to interfere with the operation of warewashing machines.

In some cases, defoaming agents have been used in an attempt to promote the use of high foaming surfactants in rinse aids. In theory, the defoaming agents may include surfactants with a cloud point at or below the temperature of the rinse water, and would thereby precipitate out and modify the air/liquid interface and destabilize the presence of foam that may be created by the high foaming surfactants in the rinse water. However, in many cases, it has been difficult to provide suitable combinations of high foaming surfactants and defoamers to achieve desired results. For example, for certain high foaming surfactants, it has often been necessary to provide defoaming agents that are chemically quite complicated. For example, Published International Patent Application No. WO89/11525 discloses an ethoxylate defoamer agent that is capped with an alkyl residue.

A number of rinse aids and preservatives are currently known, each having certain advantages and disadvantages. There is an ongoing need for alternative rinse aid compositions and their components, such as preservatives especially alternative compositions and components that are environmentally friendly (e.g., biodegradable), and that essentially include components that are suitable for use in food service industries, e.g. GRAS ingredients (generally recognized as safe by the USFDA, partial listing available at 21 C.F.R. §§184).

SUMMARY OF THE INVENTION

This invention concerns a preservative composition which may be used in ware wash detergents, instrument cleaners, rinse aids, hard surface cleaners, clean in place systems, and laundry detergents and other such cleaning and laundry products.

The invention includes a GRAS preservative system for acidification of the composition including sodium bisulfate and a combination of specific organic acids that act in a synergistic capacity. The preserved composition has the benefit of a higher melting point of approximately 110° or higher making it particularly suited for non sloughing dispensing in machine detergent and rinse aid applications. It also is particularly suited for solid compositions, such as those with urea and polyelthylene glycol or urea and sodium sulfate based solidification agents.

According to the invention it has surprisingly been found that a combination of sodium bisulfate, sorbic acid, and benzoic acid produced better preservative properties than other organic acid combinations or each acid by itself. In at least some embodiments, a use solution of the preservative when included in a detergent or rinse aid composition has a pH that is less than pH 4, and often less than pH 2. In some embodiments the preservative composition may also optionally include sulfate salt.

The preservative composition may be used on its own, or may be incorporated into other detergents or cleaning compositions. In a particularly preferred embodiment, the preservative composition is used as part of a solid composition such as a ware wash, or laundry detergent, or rinse aid composition.

A solid composition of the present invention which incorporates the preservative of the invention preferably includes a solidification system including solidifications agents such as PEG, urea and polyethylene glycol. In a particularly preferred embodiment the solid composition is a rinse aid that includes sodium sulfate and urea, and sheeting agent including one or more alcohol ethoxylates. The solid rinse aid composition may advantageously be formulated to phosphate-free and aminocarboxylate-free, as well as containing only ingredients generally recognized as safe (GRAS) for human consumption.

In at least some embodiments, the solid rinse aid may generally include a sheeting agent component comprising one or more alcohol ethoxylates that include an alkyl group that includes 12 or fewer carbon atoms and is a solid at room temperature. For example, in some embodiments, the rinse aid can include a sheeting agent component including one or more alcohol ethoxylates having the general formula: $R—O—(CH_2CH_2O)_n—H$ wherein R is a ($C_1$-$C_{12}$) alkyl group, and n is an integer in the range of 1 to 100. The rinse aid can also include an effective amount of defoamer component configured for reducing the stability of foam that may be created by the alcohol ethoxylate in an aqueous solution.

Some example methods, including heating and vigorous mixing are described for processing the rinse aid and detergent solid compositions, generally include the steps of combining the components, sodium sulfate, urea, and, if desired, any other suitable additives so as to produce the rinse aid or detergent. These steps are followed by casting, extruding, or the like to form solid product.

The detergents or rinse aid can be provided as a concentrate or as a use solution. The rinse aid or detergent concentrate is typically provided in a solid form. In general, it is expected that the concentrate will be diluted with water to provide the use solution that is then supplied to the surface of a substrate. The use solution preferably contains an effective amount of active material to provide reduced water solids filming in rinse water. It should be appreciated that the term "active materials" refers to the nonaqueous portion of the use solution that functions to remove soils or to reduce spotting and water solids filming.

Some example methods for using the rinse aid/detergents generally include the step of providing the rinse aid or detergent, mixing the rinse aid/detergent into an aqueous use solution, and applying the aqueous use solution to a substrate surface.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, wt. %, wt.-%, % by weight, and the like are synonyms that refer to the concentration of a substance as the weight of that substance divided by the weight of the composition and multiplied by 100.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

Phosphate-free refers to a composition, mixture, or ingredients to which phosphate-containing compounds are not added. Should phosphate-containing compounds be present, for example through contamination of a phosphate-free composition, mixture, or ingredients, the level of phosphate shall be less than 0.5 wt. %, may be less than 0.1 wt. %, and often less than 0.01 wt. %.

Aminocarboxylate-free refers to a composition, mixture, or ingredients to which aminocarboxylate-containing compounds are not added. Should aminocarboxylate-containing compounds be present through contamination of a aminocarboxylate-free composition, mixture, or ingredients, the level of aminocarboxylates shall be less than 0.5 wt. %, may be less than 0.1 wt. %, and often less than 0.01 wt. %.

As used herein, the term "alkyl" refers to a straight or branched chain monovalent hydrocarbon radical. Alkyl groups generally include those with one to twenty atoms. Alkyl groups may be unsubstituted or substituted with those substituents that do not interfere with the specified function of the composition. Substituents include alkoxy, hydroxy, mercapto, amino, alkyl substituted amino, or halo, for example. Examples of "alkyl" as used herein include, but are not limited to, methyl, ethyl, n-propyl, n-butyl, n-pentyl, isobutyl, and isopropyl, and the like. In addition, "alkyl" may include "alkylenes", "alkenylenes", or "alkylynes".

As used herein, the term "alkylene" refers to a straight or branched chain divalent hydrocarbon radical optionally containing one or more heteroatomic substitutions independently selected from S, O, Si, or N. Alkylene groups generally include those with one to twenty atoms. Alkylene groups may be unsubstituted or substituted with those substituents that do not interfere with the specified function of the composition. Substituents include alkoxy, hydroxy, mercapto, amino, alkyl substituted amino, or halo, for example. Examples of "alkylene" as used herein include, but are not limited to, methylene, ethylene, propane-1,3-diyl, propane-1,2-diyl and the like.

As used herein, the term "alkenylene" refers to a straight or branched chain divalent hydrocarbon radical having one or more carbon-carbon double bonds and optionally containing one or more heteroatomic substitutions independently selected from S, O, Si, or N. Alkenylene groups generally include those with one to twenty atoms. Alkenylene groups may be unsubstituted or substituted with those substituents that do not interfere with the specified function of the composition. Substituents include alkoxy, hydroxy, mercapto, amino, alkyl substituted amino, or halo, for example. Examples of "alkenylene" as used herein include, but are not limited to, ethene-1,2-diyl, propene-1,3-diyl, and the like.

As used herein, the term "alkylyne" refers to a straight or branched chain divalent hydrocarbon radical having one or more carbon-carbon triple bonds and optionally containing one or more heteroatomic substitutions independently selected from S, O, Si, or N. Alkylyne groups generally include those with one to twenty atoms. Alkylyne groups may be unsubstituted or substituted with those substituents that do not interfere with the specified function of the composition. Substituents include alkoxy, hydroxy, mercapto, amino, alkyl substituted amino, or halo, for example.

As used herein, the term "alkoxy", refers to —O-alkyl groups wherein alkyl is as defined above.

As used herein, the term "halogen" or "halo" shall include iodine, bromine, chlorine and fluorine.

As used herein, the terms "mercapto" and "sulfhydryl" refer to the substituent —SH.

As used herein, the term "hydroxy" refers to the substituent —OH.

A used herein, the term "amino" refers to the substituent $—NH_2$.

DETAILED DESCRIPTION OF THE INVENTION

The preservative composition of the invention comprises a combination of ingredients, which, when used cleaning products, improves the preservation of that product to microbial spoilage compared with the product alone. Use of the preservative composition for improving the preservation of that product means that, for example, the preservative composition slows growth of microorganisms or the like and prevents products from deteriorating by microorganisms or the like. In addition, a method for preserving products means that, for example, the preservative composition slows growth of microorganisms or the like, prevents products from deteriorating by microorganisms or the like, or stops growth of microorganisms or the like.

These ingredients may be premixed before adding to the final product but it is not a requirement of the invention to do so. Individual ingredients of the composition may be added to a product at convenient times during the manufacturing process.

Improved preservative effect may be defined either as superior biocidal effect, i.e., a reduction in the number of colonies of microbes surviving after a set time exposed to the composition in a model product composition in the preservation test described later. Alternatively improved preservation may be defined as equivalent efficacy but with reduced dosage of any conventional preservatives within the composition. The preservative composition as part of a cleaning product, would usually comprise 0.05% to 1.0% by weight of the final product composition.

The inventive include a novel GRAS preservative system for acidification of the solid rinse aid/detergent including sodium bisulfate and two organic acids consisting of benzoic and sorbic. In at least some embodiments, the solid rinse aid has pH of 2.0 or less and the use solution of the solid rinse aid has a pH of at least pH 4.0. In some embodiments sodium sulfate may also be added.

The rinse aid/detergent solid compositions of the invention include an effective amount of preservatives. Often, overall acidity and/or acids in the detergent/rinse aid composition and the use solution serves a preservative and stabilizing function.

Typically, sodium bisulfate is included in the preservative/rinse aid/detergent composition as an acid source. In certain embodiments, an effective amount of sodium bisulfate and two acids are included in the solid rinse aid/detergent composition as a preservative system. The combination of the two acids sorbic and benzoic has been shown to work better than other combinations of acids such as inorganic acids, such as HCl, ascorbic acid, erythorbic acid, citric acid, and the like for a preservative composition. The combination of sorbic acid and benzoic acid has also been shown to work better as a preservative than sodium bisulfate, or either acid alone. Generally, effective amounts of sodium bisulfate, sorbic acid, and benzoic acid are included such that a use solution of the solid rinse aid composition has a pH that shall be less than pH 4.0, often less pH 3.0, and may be even less than pH 2.0. The preservative system can also include various other functional materials.

Preservative compositions of invention are included where the bisulfate, sorbic acid, and benzoic acid are present in a ratio of 13.34:1:1, respectively in the preservative composition, either alone or as a component of a detergent or rinse aid. In certain embodiments the preservative composition includes sodium bisulfate present in an amount of from 60 wt % to about 99 wt %, and the acids are each present in an amount from about 0.5 wt % to about 20 wt % each. In a more preferred embodiment the sodium bisulfate present in an amount of from 70 wt % to about 95 wt %, and the acids are each present in an amount from about 2.5 wt % to about 15 wt % each and in an even more preferred embodiment the sodium bisulfate is present in an amount of from 80 wt % to about 90 wt %, and the acids are each present in an amount from about 5 wt % to about 10 wt % each, with any remainder being water or other suitable carrier. In an embodiment the sodium bisulfate is present in an amount of 85 wt % and the acids are each present in an amount of 7.5 wt % each.

The preservative component in a rinse aid is typically an amount of the solid rinse aid composition in an amount of from about 0.1 to 20 wt % preferable 1 to 15 wt % and most preferably 1 wt % to about 10 wt %.

In other embodiments, the preservative compositions of the invention can include other functional materials, such as sanitizers/anti-microbial agents, in addition to the components described above. Suitable sanitizers/anti-microbial agents are described below.

Additional Functional Materials

As indicated above, the preservative composition either alone or as part of to detergent/rinse aid composition may contain other functional materials. Functional materials include a material that when dispersed or dissolved in a use solution, provides a beneficial property in a particular use. Examples of such a functional material include chelating/sequestering agents; sheeting agents, defoaming agents, bleaching agents or activators; sanitizers/anti-microbial agents; activators; builder or fillers; anti-redeposition agents; optical brighteners; dyes; odorants or perfumes; preservatives; stabilizers; processing aids; corrosion inhibitors; fillers; solidifiers; hardening agent; solubility modifiers; pH adjusting agents; humectants; hydrotropes; or a broad variety of other functional materials, depending upon the desired characteristics and/or functionality of the composition. In the context of some embodiments disclosed herein, the functional materials, or ingredients, are optionally included within a solidification matrix for their functional properties. Some more particular examples of functional materials are discussed in more detail below, but it should be understood by those of skill in the art and others that the particular materials discussed are given by way of example only, and that a broad variety of other functional materials may be used.

Chelating/Sequestering Agents

The compositions of the invention may also include effective amounts a chelating/sequestering agent. In general, a chelating agent is a molecule capable of coordinating (i.e., binding) the metal ions commonly found in water sources to prevent the metal ions from interfering with the action of the other ingredients. The chelating/sequestering agent may also function as a threshold agent when included in an effective amount. In some embodiments, the compositions of the invention can include in the range of up to about 70 wt. %, or in the range of about 1-60 wt. %, of a chelating/sequestering agent.

Often, the compositions of the invention are phosphate-free and/or amino-carboxylate-free. In embodiments the compositions that are phosphate-free, the additional functional materials, including builders exclude phosphorous-containing compounds such as condensed phosphates and phosphonates.

Suitable additional builders that can function as chelants include polycarboxylates. Some examples of polymeric polycarboxylates suitable for use as sequestering agents include those having a pendant carboxylate (—$CO_2$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

Embodiments of the invention which are not aminocarboxylate-free may include added chelating/sequestering agents which are aminocarboxylates. Some examples of aminocarboxylic acids include, N-hydroxyethylaminodiacetic acid, nitrilotriacetic acid (NTA), ethylenediaminetetraacetic acid (EDTA), N-hydroxyethyl-ethylenediaminetriacetic acid (HEDTA) (in addition to the HEDTA used in the binder), diethylenetriaminepentaacetic acid (DTPA), and the like.

In embodiments of the intention which are not phosphate-free, added chelating/sequestering agents may include, for example a condensed phosphate, a phosphonate, and the like. Some examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

In embodiments of the composition which are not phosphate-free, the composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate), sodium salt

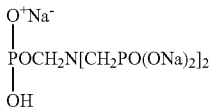

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2POOH)_2]_2]_2$; and phosphorus acid $H_3PO_3$. In some embodiments, a phosphonate combination such as ATMP and DTPMP may be used. A neutralized or alkaline phosphonate, or a combination of the phosphonate with an alkali source prior to being added into the mixture such that there is little or no heat or gas generated by a neutralization reaction when the phosphonate is added can be used.

Polyfunctionally-substituted aromatic chelating agents are also useful in the invention compositions (See U.S. Pat. No. 3,812,044). Preferred compounds of this type in acid form are dihydroxydisulfobenzenes such as 1,2-dihydroxy-3,5-disulfobenzene.

Preferred are the biodegradable chelators such as ethylenedlamine disuccinate ("EDDS"), especially the [S,S]isomer as described in U.S. Pat. No. 4,704,233, iminodisuccinate (IDS) (CAS144538-83-0 for the tetrasodium salt) known as Baypure CX100®, and 3-hydroxy-2,2'-iminodisuccinate (HIDS) (CAS 190195-65-4 for the tetrasodium salt) available from Nippon Shokubai, tetrasodium N,N-bis-(carboxylatomethyl)-L-glutamate (CAS 51981-21-6 for the tetra sodium salt) known under the trade name Dissolvine G38200 from (Akzo Nobel). The compositions herein may also contain water-soluble methyl glycine diacetic acid (MGDA) salts (or add form).

Polycarboxylic adds and their salts are a group of materials which function as sequestrants but also have other applications such as buffering or pH adjustment agents and as builders in detergent products. Builders are calcium and magnesium sequestering agents such as polycarboxylates, for example citric acid and tartaric acid, polymers and copolymers containing carboxylic add groups such as poly(maleic acid) and poly(acrylic acid) such as the Sokalan® range supplied by BASF, and tetrasodium glutamate diacetate, may be used at high levels in laundry liquids. Polyaspartic acid and salts thereof is an example of a biodegradable polymer with multiple carboxylate groups.

Preferred chelating agents include polyacrylic add and/or salts thereof, copolymers of acrylic and maleic acid and/or salts thereof, polyaspartic acid and/or salts thereof, ethylene diamine tetraacetic acid (EDTA) and/or salts thereof, citric acid and/or salts thereof, ethylenediaminedisuccinic acid and/or salts thereof, tetrasodium glutamate diacetate, N,N-bis-(carboxylatomethyl)-L-glutamic acid and/or salts thereof, iminiodisucdnic add and/or salts thereof and 3-hydroxy-2,2'-iminodisuccinic add and/or salts thereof (HIDS). ethylenediaminetetrakis(methylene-phosphonic acid) acid and/or salts thereof, diethylene pentakis (methyl phosphonic acid) add and/or salts thereof and hydroxyethylidene-1,1-diphosphonic acid and/or salts thereof and mixtures thereof.

Especially preferred chelating agents include ethylene diamine tetraacetic acid (EDTA) and/or salts thereof, citric acid and/or salts thereof, ethylenediaminedisuccinic acid and/or salts thereof, tetrasodium glutamate diacetate, N,N-bis-(carboxylatomethyl)-L-glutamatic add and/or salts thereof, polyacrylic add and/or salts thereof, copolymers of acrylic and maleic acid and/or salts thereof and mixtures thereof.

For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Bleaching Agents

The preservative compositions of the invention or detergents/rinse aids incorporating the same can optionally include bleaching agent. Bleaching agent can be used for lightening or whitening a substrate, and can include bleaching compounds capable of liberating an active halogen species, such as $Cl_2$, $Br_2$, —$OCl^-$ and/or —$OBr^-$, or the like, under conditions typically encountered during the cleansing process. Suitable bleaching agents for use can include, for example, chlorine-containing compounds, such as a chlorine, a hypochlorite, chloramines, or the like. Some examples of halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein). A bleaching agent may also include an agent containing or acting as a source of active oxygen. The active oxygen compound acts to provide a source of active oxygen, for example, may release active oxygen in aqueous solutions. An active oxygen compound can be inorganic or organic, or can be a mixture thereof. Some examples of active oxygen compound include peroxygen compounds, or peroxygen compound adducts. Some examples of active oxygen compounds or sources include hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A composition of the invention may include a minor but effective amount of a bleaching agent, for example, in some embodiments, in the range of up to about 10 wt. %, and in some embodiments, in the range of about 0.1 to about 6 wt. %.

Sanitizers/Anti-Microbial Agents

The preservative compositions, or detergents/rinse aids incorporating the same can optionally include a sanitizing agent. Sanitizing agents also known as antimicrobial agents are chemical compositions that can be used in a solid functional material to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action. Nonetheless, some embodiments incorporate additional antimicrobial agents.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Some examples of common antimicrobial agents include phenolic antimicrobials such as pentachlorophenol, orthophenylphenol, a chloro-p-benzylphenol, p-chloro-m-xylenol. Halogen containing antibacterial agents include sodium trichloroisocyanurate, sodium dichloro isocyanate (anhydrous or dihydrate), iodine-poly(vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties. Example antimicrobial agents include a blend of methylchloroisothiazolinone and methylisothiazolinone, available from Rohm and Haas under the trade name KATHON.

In embodiments of the invention which are phosphate-free, and/or aminocarboxylate-free, and also include an anti-microbial agent, the anti-microbial is selected to meet those requirements. Embodiments of the compositions of the invention which include only GRAS ingredients, may exclude or omit anti-microbial agents described in this section.

In some embodiments, the compositions of the invention comprise, an antimicrobial component, such as blends of methylchloroisothiazolinone and methylisothiazolinone, in the range of up to about 10% by wt. of the composition, in some embodiments in the range of up to about 5 wt. %, or in some embodiments, in the range of about 0.01 to about 3 wt. %, or in the range of 0.05 to 1% by wt. of the composition. In a preferred embodiment, no additional anti-microbial component is necessary as the preservative compositions of the invention provide adequate antimicrobial activity.

Activators

In some embodiments, the antimicrobial activity or bleaching activity of the compositions of the invention can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof.

In some embodiments, an activator component can include in the range of up to about 75% by wt. of the composition, in some embodiments, in the range of about 0.01 to about 20% by wt., or in some embodiments, in the range of about 0.05 to 10% by wt. of the composition. In some embodiments, an activator for an active oxygen compound combines with the active oxygen to form an antimicrobial agent.

In some embodiments, the compositions of the invention include a solid, such as a solid flake, pellet, or block, and an activator material for the active oxygen is coupled to the solid. The activator can be coupled to the solid by any of a variety of methods for coupling one solid cleaning composition to another. For example, the activator can be in the form of a solid that is bound, affixed, glued or otherwise adhered to the solid of the rinse aid composition. Alternatively, the solid activator can be formed around and encasing the solid rinse aid composition. By way of further example, the solid activator can be coupled to the solid rinse aid composition by the container or package for the composition, such as by a plastic or shrink wrap or film.

Fillers

The compositions of the invention can optionally include a minor but effective amount of one or more of a filler which does not necessarily perform as a rinse and/or cleaning agent per se, but may cooperate with a rinse agent to enhance the overall capacity of the composition. Some examples of suitable fillers may include sodium chloride, starch, sugars, $C_1$-$C_{10}$ alkylene glycols such as propylene glycol, and the like. In some embodiments, a filler can be included in an amount in the range of up to about 20 wt. %, and in some embodiments, in the range of about 1-15 wt. %. Sodium sulfate is conventionally used as inert filler. However, surprisingly, sodium sulfate was found to function in solidification in combination with urea.

Anti-Redeposition Agents

The compositions of the invention can optionally include an anti-redeposition agent capable of facilitating sustained suspension of soils in a rinse solution and preventing removed soils from being redeposited onto the substrate being rinsed. Some examples of suitable anti-redeposition agents can include fatty acid amides, fluorocarbon surfactants, complex phosphate esters, styrene maleic anhydride copolymers, and cellulosic derivatives such as hydroxyethyl cellulose, hydroxypropyl cellulose, and the like. A composition of the invention may include up to about 10 wt. %, and in some embodiments, in the range of about 1 to about 5 wt. %, of an anti-redeposition agent.

Dyes/Odorants

Various dyes, odorants including perfumes, and other aesthetic enhancing agents may also be included in the compositions of the invention. Dyes may be included to alter the appearance of the composition, as for example, FD&C Blue 1 (Sigma Chemical), FD&C Yellow 5 (Sigma Chemical), Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Products to be Preserved

Products to be preserved according to the invention, also named final products (detergents/rinse aids) in the present description, are household, industrial, and laundry compositions which are not intended for human or animal ingestion.

Household cleansing preparations include general purpose cleansers, liquids, mousses, creams and abrasive liquids, laundry liquid and solid detergents, fine wash products, rinse aids, warewash detergents, hard surface cleaners and the like.

Products to be preserved will contain a certain proportion of water, generally at least 15% by weight, in many cases at least 30% by weight and in most products more than 60% by weight or even higher proportions in a use composition. Furthermore, such products will usually contain some surface active materials, either as an emulsifier, if the product is an emulsion, or as a detergent active material if the product has some kind of cleaning activity.

Articles or substrates such as pads, sponges or wipes made from non woven textiles, may be impregnated with liquids for cleaning inanimate surfaces such as kitchen worktops, tiled surfaces, bathroom sanitary ware, windows, leather goods and soft furnishings. Some products may fall into more than one category.

Final products containing preservative compositions of the present invention typically comprise from about 15% by weight to about 95% by weight, preferably from about 25% by weight to about 90% by weight, more preferably from about 30% by weight to about 80% by weight of water in a use composition.

Preferred Solid Detergent/Rinse Aids

In a preferred embodiment the preservative composition of the invention is incorporated in to a ware wash detergent and/or rinse aid product. The invention in such an embodiment provides a solid composition preferably including effective amounts of a solidification system including, for example sodium sulfate and urea. The combination of sodium sulfate and urea has been found to add to performance of the solid detergent/rinse aid, at least by functioning as solidification agents. The combination of sodium sulfate and urea may also function as builders. The solid rinse aid composition typically has a melt point greater than 110° F. and is dimensionally stable.

The solid rinse aid/detergent generally includes an effective amount of sheeting agent including one or more alcohol ethoxylates that include an alkyl group that includes 12 or fewer carbon atoms. Preferably, one or more of the alcohol ethoxylates are solid at room temperature. For example, in some embodiments, the rinse aid sheeting agent including one or more alcohol ethoxylates having the general formula: $R—O—(CH_2CH_2O)_n—H$ wherein R is a ($C_1$-$C_{12}$) alkyl group, and n is an integer in the range of 1 to 100.

The rinse aid/detergent also generally includes an effective amount of defoamer component configured for reducing the stability of foam that may be created by the alcohol ethoxylate in an aqueous solution.

Typically, the solid rinse aid/detergent is formulated to include components that are suitable for use in food service industries, e.g., GRAS ingredients, a partial listing is available at 21 CFR 184. In some embodiments, the solid rinse aid is formulated to include only GRAS ingredients. In other embodiments, the solid rinse aid is formulated to include GRAS and biodegradable ingredients. In addition, the solid rinse aid may be formulated to be environmentally friendly by excluding phosphates and aminocarboxylates.

The solid rinse aid/detergent compositions may also include other functional agents and active ingredients that will vary according to the type of rinse aid composition being manufactured in the solid matrix formed by the sodium sulfate and urea. The invention further provides methods for making solid rinse aid/detergent compositions, including effective amounts of sodium sulphate and urea in combination with alcohol ethoxylate sheeting agent.

The rinse aid/detergent in a preferred embodiment is provided as a solid. Typically, the solid rinse aid/detergent is provided as a solid block or pellet. It is expected that blocks will have a size of at least about 5 grams, and can include a size of greater than about 50 grams. For the purpose of this application the term "solid block" includes extruded pellet materials having a weight of 50 grams up through 250 grams, an extruded solid with a weight of about 100 grams or greater or a solid block rinse aid having a mass between about 1 and 10 kilograms.

Solidification Agents

The solid rinse aid/detergent composition in one embodiment includes an effective amount of a combination of sodium sulfate and urea for solidification. In general, an effective amount of effective amount of sodium sulfate and urea is considered an amount that acts with or without other materials to solidify the rinse aid composition. Typically, the combined amount of sodium sulfate and urea in a solid rinse aid composition is in a range of 18 to 70% by weight of the solid rinse aid composition, with 3-24 wt. % sodium sulfate and 15-50 wt. % urea. In other embodiments, the combined amount of sodium sulfate and urea is in a range of 10 to 50 wt. %, with 5-18 wt. % sodium sulfate and 5-45 wt. % urea. In some instances, the combined amount of sodium sulfate and urea in a range of 20 to 37% by weight of the rinse aid composition, with 10-16 wt. % sodium sulfate and 16-27 wt. % urea. Sodium sulfate and urea are commercially available.

The rinse aid/detergent composition hardens into solid form due to the chemical reaction of the ingredients with the sodium sulfate and urea. The solidification process may last from a few minutes to about four hours, depending, for example, on the size of the cast, pressed or extruded composition, the ingredients of the composition, the temperature of the composition, and other like factors. Typically, the composition of the present disclosure exhibits extended mix time capability. Often, the cast or extruded composition "sets up" or begins to harden to a solid form within 1 minute to about 3 hours. For example, the cast or extruded composition "sets up" or begins to harden to a solid form within a range of 1 minute to 2 hours. In some instances, the cast or extruded composition "sets up" or begins to harden to a solid form with a range of 1 minute to about 20 minutes.

Water

The solid rinse aid/detergent compositions include water. Solidification of the composition with sodium sulfate and sodium bisulfate accommodates higher water levels than conventional solidification relying on PEG or urea but either solidification system can be used according to the invention. Water many be independently added to the solid rinse aid/detergent composition or may be provided in the composition as a result of its presence in an aqueous material that is added to the composition. Typically, sodium bisulfate is combined with water or other aqueous materials prior to completing addition of other materials. For example, materials added to the solid rinse aid/detergent composition include water or may be prepared in an aqueous premix available for reaction with the solidification agent component(s). Typically, water is introduced into the composition to provide the solid rinse aid/detergent composition with a desired viscosity prior to solidification, and to provide a desired rate of solidification.

In general, it is expected that water may be present as a processing aid and may be removed or become water of hydration. In the solid composition, it is expected that the water will be present in the solid rinse aid composition in the range of between 2 wt. % and 15 wt. %. For example, water is present in embodiments of the solid rinse aid composition in the range of between 2 wt. % to about 12 wt. %, or further embodiments in the range of between 3 wt. % and about 10 wt. %, or yet further embodiments in the range of between 3 wt. % and 4 wt. %. It should be additionally appreciated that the water may be provided as deionized water or as softened water.

The components used to form the solid composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid.

Sheeting Agent

The solid rinse aid/detergent compositions of the invention can include a sheeting agent. The sheeting agent includes an effective amount of one or more alcohol ethoxylate compounds. Typically, the sheeting agent includes an effective amount of one or more alcohol ethoxylate compounds that include an alkyl group that has 12 or fewer carbon atoms. Typically, the blend of one or more alcohol ethoxylate compounds in the sheeting agent is a solid at room temperature, for example by having a melting point equal to or greater than 100° F., often greater than 110° F., and frequently in the range of 110° F. to 120° F. In at least some embodiments, alcohol ethoxylate compounds may each independently have structure represented by Formula I: $R—O—(CH_2CH_2O)_n—H$ (I) wherein R is a ($C_1$-$C_{12}$) alkyl group and n is an integer in the range of 1 to 100. In some embodiments, R may be a ($C_8$-$C_{12}$) alkyl group, or may be a ($C_8$-$C_{10}$) alkyl group. Similarly, in some embodiments, n is an integer in the range of 10-50, or in the range of 15-30, or in the range of 20-25. In some embodiments, the one or more alcohol ethoxylate compounds are straight chain hydrophobes.

In at least some embodiments, the sheeting agent includes at least two different alcohol ethoxylate compounds each having structure represented by Formula I. In other words, the R and/or n variables of Formula I, or both, may be different in the two or more different alcohol ethoxylate compounds present in the sheeting agent. For example, the sheeting agent in some embodiments may include a first alcohol ethoxylate compound in which R is a ($C_8$-$C_{10}$) alkyl group, and a second alcohol ethoxylate compound in which R is a ($C_{10}$-$C_{12}$) alkyl group. In at least some embodiments, the sheeting agent does not include any alcohol ethoxylate compounds that include an alkyl group that has more than 12 carbon atoms. In some embodiments, the sheeting agent includes only alcohol ethoxylate compounds that include an alkyl group that has 12 or fewer carbon atoms.

In some embodiments where, for example, the sheeting agent includes at least two different alcohol ethoxylate compounds, the ratio of the different alcohol ethoxylate compounds can be varied to achieve the desired characteristics of the final composition. For example, in some embodiments including a first alcohol ethoxylate compound and a second alcohol ethoxylate compound, the ratio of weight-percent first alcohol ethoxylate compound to weight-percent second compound may be in the range of about 1:1 to about 10:1 or more. For example, in some embodiments, the sheeting agent can include in the range of about 50% weight percent or more of the first compound, and in the range of about 50 weight percent or less of the second compound, and/or in the range of about 75 weight percent or more of the first compound, and in the range of about 25 weight percent or less of the second compound, and/or in the range of about 85 weight percent or more of the first compound, and in the range of about 15 weight percent or less of the second compound. Similarly, the range of mole ratio of the first compound to the second compound may be about 1:1 to about 10:1, and in some embodiments, in the range of about 3:1 to about 9:1.

In some embodiments, the alcohol ethoxylates used in the sheeting agent can be chosen such that they have certain characteristics, for example, are environmentally friendly, are suitable for use in food service industries, and/or the like. For example, the particular alcohol ethoxylates used in the sheeting agent may meet environmental or food service regulatory requirements, for example, biodegradability requirements.

Some specific examples of suitable sheeting agents that may be used include an alcohol ethoxylate combination including a first alcohol ethoxylate wherein R is a $C_{10}$ alkyl group and n is 21 (i.e., 21 moles ethylene oxide) and a second alcohol ethoxylate wherein R is a $C_{12}$ alkyl group and again, n is 21 (i.e., 21 moles ethylene oxide). Such a combination can be referred to as an alcohol ethoxylate $C_{10-12}$, 21 moles EO. In some particular embodiments, the sheeting agent may include in the range of about 85 wt. % or more of the $C_{10}$ alcohol ethoxylate and about 15 wt. % or less of the $C_{12}$ alcohol ethoxylate. For example, the sheeting agent may include in the range of about 90 wt. % of the $C_{10}$ alcohol ethoxylate and about 10 wt. % of the $C_{12}$ alcohol ethoxylate. One example of such an alcohol ethoxylate mixture is commercially available from Sasol under the trade name NOVEL II 1012-21. Alcohol ethoxylate surfactants are also described in U.S. application Ser. No. 10/703,042, assigned to Ecolab, herein incorporated by reference.

The sheeting agent can comprise a very broad range of weight percent of the entire composition, depending upon the desired properties. For example, for concentrated embodiments, the sheeting agent can comprise in the range of 1 to about 10 wt.-% of the total composition, in some embodiments in the range of about 5 to about 25 wt.-% of the total composition, in some embodiments in the range of about 20 to about 50 wt.-% of the total composition, and in some embodiments in the range of about 40 to about 90 wt.-% of the total composition. For some diluted or use solutions, for example, aqueous use solutions, the sheeting agent can comprise in the range of 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the total use solution.

Defoamer Component

The rinse aid/detergent composition can also include an effective amount of defoamer component configured for reducing the stability of foam that may be created by the alcohol ethoxylate sheeting agent in an aqueous solution. Any of a broad variety of suitable defoamers may be used, for example, any of a broad variety of nonionic ethylene oxide (EO) containing surfactants. Many nonionic ethylene oxide derivative surfactants are water soluble and have cloud points below the intended use temperature of the rinse aid composition, and therefore may be useful defoaming agents. In addition, where the solid rinse aid composition is preferred to be biodegradable, the defoamers are also selected to be biodegradable.

While not wishing to be bound by theory, it is believed that suitable nonionic EO containing surfactants are hydrophilic and water soluble at relatively low temperatures, for example, temperatures below the temperatures at which the rinse aid will be used. It is theorized that the EO component forms hydrogen bonds with the water molecules, thereby solubilizing the surfactant. However, as the temperature is increased, these hydrogen bonds are weakened, and the EO containing surfactant becomes less soluble, or insoluble in water. At some point, as the temperature is increased, the cloud point is reached, at which point the surfactant precipitates out of solution, and functions as a defoamer. The surfactant can therefore act to defoam the sheeting agent component when used at temperatures at or above this cloud point.

The cloud point of nonionic surfactant of this class is defined as the temperature at which a 1 wt.-% aqueous solution. Therefore, the surfactant and/or surfactants chosen for use in the defoamer component can include those having appropriate cloud points that are below the intended use temperature of the rinse aid. Those of skill and the art, knowing the intended use temperature of the rinse aid, will appreciate surfactants with appropriate cloud points for use as defoamers.

For example, there are two general types of rinse cycles in commercial warewashing machines. A first type of rinse cycle can be referred to as a hot water sanitizing rinse cycle because of the use of generally hot rinse water (about 180° F.). A second type of rinse cycle can be referred to as a chemical sanitizing rinse cycle and it uses generally lower temperature rinse water (about 120° F.). A surfactant useful as a defoamer in these two conditions is one having a cloud point less than the rinse water temperature. Accordingly, in this example, the highest useful cloud point, measured using a 1 wt.-% aqueous solution, for the defoamer is approximately 180° F. or less. It should be understood, however, that the cloud point can be lower or higher, depending on the use locus water temperature. For example, depending upon the use locus water temperature, the cloud point may be in the range of about 0 to about 100° C. Some examples of common suitable cloud points may be in the range of about 50° C. to about 80° C., or in the range of about 60° C. to about 70° C.

Some examples of ethylene oxide derivative surfactants that may be used as defoamers include polyoxyethylene-polyoxypropylene block copolymers, alcohol alkoxylates, low molecular weight EO containing surfactants, or the like, or derivatives thereof. Some examples of polyoxyethylene-polyoxypropylene block copolymers include those having the following formulae:

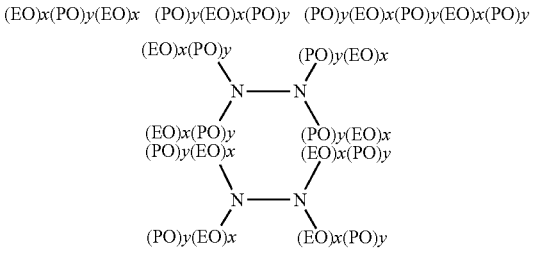

wherein EO represents an ethylene oxide group, PO represents a propylene oxide group, and x and y reflect the average molecular proportion of each alkylene oxide monomer in the overall block copolymer composition. In some embodiments, x is in the range of about 10 to about 130, y is in the range of about 15 to about 70, and x plus y is in the range of about 25 to about 200. It should be understood that each x and y in a molecule can be different. In some embodiments, the total polyoxyethylene component of the block copolymer can be in the range of at least about 20 mol-% of the block copolymer and in some embodiments, in the range of at least about 30 mol-% of the block copolymer. In some embodiments, the material can have a molecular weight greater than about 400, and in some embodiments, greater than about 500. For example, in some embodiments, the material can have a molecular weight in the range of about 500 to about 7000 or more, or in the range of about 950 to about 4000 or more, or in the range of about 1000 to about 3100 or more, or in the range of about 2100 to about 6700 or more.

Although the exemplary polyoxyethylene-polyoxypropylene block copolymer structures provided above have 3-8 blocks, it should be appreciated that the nonionic block copolymer surfactants can include more or less than 3 or 8 blocks. In addition, the nonionic block copolymer surfactants can include additional repeating units such as butylene oxide repeating units. Furthermore, the nonionic block copolymer surfactants that can be used according to the invention can be characterized hetero-polyoxyethylene-polyoxypropylene block copolymers. Some examples of suitable block copolymer surfactants include commercial products such as PLURONIC® and TETRONIC® surfactants, commercially available from BASF. For example, PLURONIC® 25-R4 is one example of a useful block copolymer surfactant commercially available from BASF, that is biodegradable and GRAS (generally recognized as safe).

It is believed that one skilled in the art would understand that a nonionic surfactant with an unacceptably high cloud point temperature or an unacceptably high molecular weight would either produce unacceptable foaming levels or fail to provide adequate defoaming capacity in a rinse aid composition.

The defoamer component can comprise a very broad range of weight percent of the entire composition, depending upon the desired properties. For example, for concentrated embodiments, the defoamer component can comprise in the range of 1 to about 10 wt.-% of the total composition, in some embodiments in the range of about 5 to about 25 wt.-% of the total composition, in some embodiments in the range of about 20 to about 50 wt.-% of the total composition, and in some embodiments in the range of about 40 to about 90 wt.-% of the total composition. For some diluted or use solutions, the defoamer component can comprise in the range of 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the use solution.

The amount of defoamer component present in the composition can also be dependent upon the amount of sheeting agent present in the composition. For example, the less sheeting agent present in the composition may provide for the use of less defoamer component. In some example embodiments, the ratio of weight-percent sheeting agent component to weight-percent defoamer component may be in the range of about 1:5 to about 5:1, or in the range of about 1:3 to about 3:1. Those of skill in the art will recognize that the ratio of sheeting agent component to defoamer component may be dependent on the properties of either and/or both actual components used, and these ratios may vary from the example ranges given to achieve the desired defoaming effect. Defoamer components are also described in U.S. application Ser. No. 10/703,042, assigned to Ecolab, herein incorporated by reference.

Additional Hardening/Solidification Agents/Solubility Modifiers

Typically, sodium sulfate and urea are used for solidification of the solid rinse aid composition however, in some embodiments, other hardening agents may be included in addition to or in lieu of the sodium sulfate and urea system. Examples of hardening agents include an amide such stearic monoethanolamide or lauric diethanolamide, or an alkylamide, and the like; a solid polyethylene glycol, or a solid EO/PO block copolymer, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the rinse aid and/or other active ingredients may be dispensed from the solid composition over an extended period of time. The composition may include a secondary hardening agent in an amount in the range of up to about 30 wt. %. In some embodiments, secondary hardening agents are may be present in an amount in the range of 5-25 wt. %, often in the range of 10 to 25 wt. % and sometimes in the range of about 5 to about 15 wt.-%.

Additional Sheeting Aids

The composition can optionally include one or more additional rinse aid components, for example, an additional wetting or sheeting agent components in addition to the alcohol ethoxylate component discussed above. For example, water soluble or dispersible low foaming organic material capable of aiding in reducing the surface tension of the rinse water to promote sheeting action and/or to aid in reducing or preventing spotting or streaking caused by beaded water after rinsing is complete may also be included. Such sheeting agents are typically organic surfactant like materials having a characteristic cloud point. Surfactants useful in these applications are aqueous soluble surfactants having a cloud point greater than the available hot service water, and the cloud point can vary, depending on the use locus hot water temperature and the temperature and type of rinse cycle.

Some examples of additional sheeting agents can typically comprise a polyether compound prepared from ethylene oxide, propylene oxide, or a mixture in a homopolymer or block or hetero-copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents can have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly(PO) or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below: $(EO)_n$-$(PO)_m$-$(EO)_n$ wherein m is an integer of 20 to 60, and each end is independently an integer of 10 to 130. Another useful block copolymer are block copolymers having a center block of polyoxyethylene units and blocks of polyoxypropylene to each side of the center block. Such copolymers have the formula: $(PO)_n$-$(EO)_m$-$(PO)_n$ wherein m is an integer of 15 to 175, and each end are independently integers of about 10 to 30. For solid compositions, a hydrotrope may be used to aid in maintaining the solubility of sheeting or wetting agents. Hydrotropes can be used to modify the aqueous solution creating increased solubility for the organic material. In some embodiments, hydrotropes are low molecular weight aromatic sulfonate materials such as xylene sulfonates and dialkyldiphenyl oxide sulfonate materials.

Functional Polydimethylsiloxones

The composition can also optionally include one or more functional polydimethylsiloxones. For example, in some embodiments, a polyalkylene oxide-modified polydimethylsiloxane, nonionic surfactant or a polybetaine-modified polysiloxane amphoteric surfactant can be employed as an additive. Both, in some embodiments, are linear polysiloxane copolymers to which polyethers or polybetaines have been grafted through a hydrosilation reaction. Some examples of specific siloxane surfactants are known as SILWET® surfactants available from Union Carbide or ABIL® polyether or polybetaine polysiloxane copolymers available from Goldschmidt Chemical Corp., and described in U.S. Pat. No. 4,654,161 which patent is incorporated herein by reference. In some embodiments, the particular siloxanes used can be described as having, e.g., low surface tension, high wetting ability and excellent lubricity. For example, these surfactants are said to be among the few capable of wetting polytetrafluoroethylene surfaces. The siloxane surfactant employed as an additive can be used alone or in combination with a fluorochemical surfactant. In some embodiments, the fluorochemical surfactant employed as an additive optionally in combination with a silane, can be, for example, a nonionic fluorohydrocarbon, for example, fluorinated alkyl polyoxyethylene ethanols, fluorinated alkyl alkoxylate and fluorinated alkyl esters.

Further description of such functional polydimethylsiloxones and/or fluorochemical surfactants are described in U.S. Pat. Nos. 5,880,088; 5,880,089; and 5,603,776, all of which patents are incorporated herein by reference. We have found, for example, that the use of certain polysiloxane copolymers in a mixture with hydrocarbon surfactants provides excellent rinse aids on plastic ware. We have also found that the combination of certain silicone polysiloxane copolymers and fluorocarbon surfactants with conventional hydrocarbon surfactants also provide excellent rinse aids on plastic ware. This combination has been found to be better than the individual components except with certain polyalkylene oxide-modified polydimethylsiloxanes and polybetaine polysiloxane copolymers, where the effectiveness is about equivalent. Therefore, some embodiments encompass the polysiloxane copolymers alone and the combination with the fluorocarbon surfactant can involve polyether polysiloxanes, the nonionic siloxane surfactants. The amphoteric siloxane surfactants, the polybetaine polysiloxane copolymers may be employed alone as the additive in the rinse aids to provide the same results.

In some embodiments, the composition may include functional polydimethylsiloxones in an amount in the range of up to about 10 wt.-%. For example, some embodiments may include in the range of about 0.1 to 10 wt.-% of a polyalkylene oxide-modified polydimethylsiloxane or a polybetaine-modified polysiloxane, optionally in combination with about 0.1 to 10 wt.-% of a fluorinated hydrocarbon nonionic surfactant.

Humectant

The composition can also optionally include one or more humectants. A humectant is a substance having an affinity for water. The humectant can be provided in an amount sufficient to aid in reducing the visibility of a film on the substrate surface. The visibility of a film on substrate surface is a particular concern when the rinse water contains in excess of 200 ppm total dissolved solids. Accordingly, in some embodiments, the humectant is provided in an amount sufficient to reduce the visibility of a film on a substrate surface when the rinse water contains in excess of 200 ppm total dissolved solids compared to a rinse agent composition not containing the humectant. The terms "water solids filming" or "filming" refer to the presence of a visible, continuous layer of matter on a substrate surface that gives the appearance that the substrate surface is not clean.

Some example humectants that can be used include those materials that contain greater than 5 wt. % water (based on dry humectant) equilibrated at 50% relative humidity and room temperature. Exemplary humectants that can be used include glycerin, propylene glycol, sorbitol, alkyl polyglycosides, polybetaine polysiloxanes, and mixtures thereof. In some embodiments, the rinse agent composition can include humectant in an amount in the range of up to about 75% based on the total composition, and in some embodiments, in the range of about 5 wt. % to about 75 wt. % based on the weight of the composition. In some embodiments, where humectant is present, the weight ratio of the humectant to the sheeting agent can be in the range of about 1:3 or greater, and in some embodiments, in the range of about 5:1 and about 1:3.

Other Ingredients

A wide variety of other ingredients useful in providing the particular rinse aid/detergent compositions being formulated with the preservative composition of the invention to include desired properties or functionality may also be included. For example, the rinse aid may include other active ingredients, such as pH modifiers, buffering agents, cleaning enzyme, carriers, processing aids, or others, and the like.

Processing and/or Manufacturing of the Composition

The invention also relates to a method of processing and/or making the solid rinse aid/detergent or preservative composition. The solid rinse aid/detergent composition is generally provided as a solid concentrate, e.g., block. In general, it is expected that the composition will be diluted with water to provide the use solution that is then supplied to the surface of a substrate, for example, during a rinse, wash or pre-soak cycle. The use solution preferably contains an effective amount of active material to provide reduced water solids filming in high solids containing water.

The solid rinse aid/detergent composition can be processed and formulated using conventional equipment and techniques. The desired amount of the sheeting agent component and the defoamer component is provided, along with sodium sulfate, sodium bisulfate, and any other optional ingredients, such as one or more additional solidification agents. The components are vigorously admixed and heated, typically in the range of 100 to 140° F. The vigorous admixing and heating may be performed in a TEKMAR mixer or an extruder system or other similar equipment. The complete mixture is subsequently extruded into the desired form or cast into a mold, cooled or chilled. Molded forms may be removed from the molds or remain in the container (i.e. mold)

It should be understood that compositions and methods embodying the invention are suitable for preparing a variety of solid compositions, as for example, a cast, extruded, pressed, molded or formed solid pellet, block, tablet, and the like. In some embodiments, the solid composition can be formed to have a weight of 50 grams or less, while in other embodiments, the solid composition can be formed to have a weight of 50 grams or greater, 500 grams or greater, or 1 kilogram or greater. For the purpose of this application the term "solid block" includes cast, formed, pressed, or extruded materials having a weight of 50 grams or greater. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

The various liquid materials included in the rinse aid/detergent composition are adapted to a solid form by incorporating into the composition sodium sulfate and urea, optionally accompanied by one or more organic and inorganic solidifying materials. Other examples of casting agents include polyethylene glycol, and nonionic polyethylene or polypropylene oxide polymer. In some embodiments, polyethylene glycols (PEG) are used in melt type solidification processing by uniformly blending the sheeting agent and other components with PEG at a temperature above the melting point of the PEG and cooling the uniform mixture.

In some embodiments, in the formation of a solid composition, a mixing system may be used to provide for continuous mixing of the ingredients at high enough shear to form a substantially homogeneous solid or semi-solid mixture in which the ingredients are distributed throughout its mass. In some embodiments, the mixing system includes means for mixing the ingredients to provide shear effective for maintaining the mixture at a flowable consistency, with a viscosity during processing in the range of about 1,000-1,000,000 cP, or in the range of about 50,000-200,000 cP. In some example embodiments, the mixing system can be a continuous flow mixer or in some embodiments, an extruder, such as a single or twin screw extruder apparatus. A suitable amount of heat may be applied from an external source to facilitate processing of the mixture.

The mixture is typically processed at a temperature to maintain the physical and chemical stability of the ingredients. In some embodiments, the mixture is processed at temperatures in the range of about 100 to 140° F. In certain other embodiments, the mixture is processed at temperatures in the range of 110-125° F. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the sheeting agent, the defoamer, an aqueous medium, and additional ingredients such as a hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate then can be divided into useful sizes with a controlled mass. Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. In some embodiments, the temperature of the mixture during processing, including at the discharge port, is maintained in the range of about 100 to 140 ° F.

The composition hardens due to the chemical or physical reaction of the requisite ingredients forming the solid. The solidification process may last from a few minutes to about six hours, or more, depending, for example, on the size of the cast or extruded composition, the ingredients of the composition, the temperature of the composition, and other like factors. In some embodiments, the cast or extruded composition "sets up" or begins to hardens to a solid form within about 1 minute to about 3 hours, or in the range of about 1 minute to about 2 hours, or in some embodiments, within about 1 minute to about 20 minutes.

In some embodiments, the extruded solid can be packaged, for example in a container or in film. The temperature of the mixture when discharged from the mixing system can be sufficiently low to enable the mixture to be cast or extruded directly into a packaging system without first cooling the mixture. The time between extrusion discharge and packaging may be adjusted to allow the hardening of the composition for better handling during further processing and packaging. In some embodiments, the mixture at the point of discharge is in the range of about 100 to 140° F. In certain other embodiments, the mixture is processed at temperatures in the range of 110-125° F. The composition is then allowed to harden to a solid form that may range from a low density, sponge-like, malleable, caulky consistency to a high density, fused solid, concrete-like solid.

An example cast solid rinse aid/detergent of the present invention may be prepared as follows: solvate the sodium bisulfate in aqueous solution, add sheeting agent(s), defoamer(s), and heat while admixing to maintain as a liquid, e.g., 100-140° F. Add urea and TEKMAR the mixture (e.g., vigorously mix). Add sodium sulfate, continue mixing, cast into a form. Additional ingredients, such as acid preservatives and dyes may be added at any stage prior to final mixing with sodium sulfate. Chill the form and pop-out the solid rinse aid composition.

In an alternative example, a liquid premix is prepared by heated admixing of water, sodium bisulfate, sheeting agent(s), and surfactant(s) and separate preparation of a powder premix of acids, sodium sulfate, and urea. The powder premix is admixed into the heated liquid premix, for example using an extruder. The final product is extruded and cooled.

Packaging System

The solid rinse aid/detergent composition can be, but is not necessarily, incorporated into a packaging system or receptacle. The packaging receptacle or container may be rigid or flexible, and include any material suitable for containing the compositions produced, as for example glass, metal, plastic film or sheet, cardboard, cardboard composites, paper, or the like. Solid detergent/rinse aid compositions may be allowed to solidify in the packaging or may be packaged after formation of the solids in commonly available packaging and sent to distribution center before shipment to the consumer.

For solids, advantageously, in at least some embodiments, since the solid composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. In some embodiments, the packaging used to contain the rinse aid/detergent is manufactured from a flexible, easy opening film material.

Dispensing/Use of the Rinse Aid/Detergent

The rinse aid/detergent incorporating the preservative system of the invention can be dispensed as a concentrate or as a use solution. In addition, the concentrate can be provided in a solid form or in a liquid form. In general, it is expected that the concentrate will be diluted with water to provide the use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a rinse, wash or pre-soak application, for example, during a rinse cycle or wash cycle, for example, in a warewashing machine, a car wash application, clean in place system or the like. In some embodiments, formation of a use solution can occur from a rinse agent installed in a cleaning machine, for example onto a dish rack. The rinse agent/detergent can be diluted and dispensed from a dispenser mounted on or in the machine or from a separate dispenser that is mounted separately but cooperatively with the dish machine.

For example, in some embodiments, liquid rinse agents/detergents can be dispensed by incorporating compatible packaging containing the liquid material into a dispenser adapted to diluting the liquid with water to a final use concentration. Some examples of dispensers for the liquid rinse agent of the invention are DRYMASTER-P sold by Ecolab Inc., St. Paul, Minn.

In other example embodiments, solid products, such as cast or extruded solid compositions, may be conveniently dispensed by inserting a solid material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a warewashing machine in the rinse cycle. When demanded by the machine, the dispenser directs a spray of water onto the cast solid block of rinse agent/detergent which effectively dissolves a portion of the block creating a concentrated aqueous solution which is then fed directly into the rinse water forming the aqueous rinse or the wash water forming the wash. The aqueous rinse or wash is then contacted with the dishes to affect a complete wash, rinse or initial presoak. This dispenser and other similar dispensers are capable of controlling the effective concentration of the active portion in the aqueous solution by measuring the volume of material dispensed, the actual concentration of the material in the water (an electrolyte measured with an electrode) or by measuring the time of the spray on the cast block. In general, the concentration of active portion in the aqueous solution is preferably the same as identified above for liquid rinse agents. Some other embodiments of spray-type dispenser are disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. An example of a particular product shape is shown in FIG. 9 of U.S. Pat. No. 6,258,765, which is incorporated herein by reference.

In some embodiments, the compositions of the invention may be formulated for a particular application. For example, in some embodiments, the preservative composition may be may be particularly formulated in detergents or rinse aids for use in warewashing machines. As discussed above, there are two general types of rinse cycles in commercial warewashing machines. A first type of rinse cycle can be referred to as a hot water sanitizing rinse cycle because of the use of generally hot rinse water (about 180° F.). A second type of rinse cycle can be referred to as a chemical sanitizing rinse cycle and it uses generally lower temperature rinse water (about 120° F.).

In some embodiments, it is believed that the rinse aid/detergent compositions of the invention can be used in a high solids containing water environment in order to reduce the appearance of a visible film caused by the level of dissolved solids provided in the water. In general, high solids containing water is considered to be water having a total dissolved solids (TDS) content in excess of 200 ppm. In certain localities, the service water contains total dissolved solids content in excess of 400 ppm, and even in excess of 800 ppm. The applications where the presence of a visible film after washing a substrate is a particular problem includes the restaurant or warewashing industry, the car wash industry, and the general cleaning of hard surfaces. Exemplary articles in the warewashing industry that can be treated with a rinse aid according to the invention include dishware, cups, glasses, flatware, and cookware. For the purposes of this invention, the terms "dish" and "ware" are used in the broadest sense to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room. In general, these types of articles can be referred to as food or beverage contacting articles because they have surfaces which are provided for contacting food and/or beverage. When used in these warewashing applications, the rinse aid should provide effective sheeting action and low foaming properties. In addition to having the desirable properties described above, it may also be useful for the rinse aid to be biodegradable, environmentally friendly, and generally nontoxic. A rinse aid/detergent of this type may be described as being "food grade".

The above description provides a basis for understanding the broad meets and bounds of the invention. The following examples and test data provide an understanding of certain specific embodiments of the invention. The invention will be further described by reference to the following detailed examples. These examples are not meant to limit the scope of the invention. Variation within the concepts of the invention is apparent to those skilled in the art.

EXAMPLES

Example 1

Solid Rinse Aid Compositions

Each of the formulations, A through F, according to the present invention includes the combination Sodium Sulfate and urea for solid formation with defoamer (Polyoxypropylene polyoxyethylene Block copolymer) and a sheeting agent (solid alcohol ethoxylates), as well as sufficient acid (sorbic, benzoic and sodium bisulfate) acting as effective preservative. Example formulas D and F are also GRAS and biodegradable. In contrast, the conventional solid rinse aid uses propylene glycol and urea at lower water content water for solidification.

TABLE 1

| Formulation Ingredients | A | B | C | D | E | F | Conventional Solid Rinse Aid |
|---|---|---|---|---|---|---|---|
| Water | 12.50 | 12.50 | 12.50 | 12.50 | 12.50 | 12.50 | 3.29 |
| alcohol ethoxylates | 20.11 | 20.11 | 20.11 | 20.11 | 27.37 | 27.37 | — |
| Polyoxypropylene polyoxyethylene Block copolymer (LDO-97) | 14.08 | 14.08 | 14.08 | — | 19.16 | — | 64.62 |
| Polyoxypropylene polyoxyethylene Block copolymer (DO-97) | 5.67 | 5.67 | 5.67 | — | 8.21 | — | 9.00 |
| polydimethyl siloxones (30%) | 1.21 | 1.21 | 1.21 | 1.21 | — | — | — |
| Polyoxypropylene polyoxyethylene Block copolymer (Plurafac 25R2) | — | — | — | 23.44 | — | 27.37 | — |
| FD&C Blue #1 (34% Soln) | 0.27 | 0.2724 | 0.27 | 0.27 | 0.27 | 0.27 | — |
| FD&C Yellow #5 | 0.01 | 0.0142 | 0.01 | 0.01 | 0.01 | 0.01 | — |
| Sorbic Acid | — | 0.5000 | 0.50 | 0.50 | — | — | — |
| Benzoic Acid | — | 0.5000 | 0.50 | 0.50 | — | — | — |
| HCl (31.5%) | — | — | — | — | 0.06 | 0.06 | 0.06 |
| Urea | 24.70 | 24.70 | 26.00 | 26.00 | 16.00 | 16.00 | 16.00 |

TABLE 1-continued

| Formulation Ingredients | A | B | C | D | E | F | Conventional Solid Rinse Aid |
|---|---|---|---|---|---|---|---|
| Sodium Bisulfate | 6.67 | 6.67 | 6.67 | 6.67 | — | — | — |
| Sodium Sulfate | 14.78 | 13.78 | 10.00 | 10.00 | 12.69 | 12.69 | — |
| Propylene Glycol | — | — | — | — | 3.00 | 3.00 | 3.00 |
| Linear alcohol C12-15, 12 mole ethoxylate (Neodol 25-12) | — | — | — | — | — | — | 3.00 |
| Preservative (Kathon) | — | — | — | — | 0.74 | 0.74 | 0.74 |

The alcohol ethoxylates used in the formulas above are solid ($C_{10}$-$C_{16}$) linear alcohol ethoxylates available under the trade name NOVEL II 1012 GB-21, from Sasol. LDO-97 and DO-97 are trade names of polyoxypropylene polyoxyethylene block copolymers available from Huntsman Chemical. PLURONIC 25R2 is a trade name of BASF Wyandotte and consists of a block copolymer of ethylene oxide and propylene oxide. The polydimethylsiloxones used in the formulas above are dimethicone propyl PG-Betaine, 30% available from Degussa under the trade name Abil B 9950.

The preservative in the comparative example is a blend of methylchloroisothiazolinone and methylisothiazolinone available from Rohm and Haas under the trade name KATHON.

The water, solid alcohol ethoxylates (NOVEL II 1012 GB-21), PO/EO block copolymers (LDO-97, DO-97, PLURAFAC) and polydimethylsiloxones (ABIL) are combined, heated to 115-120° F. to melt the solid alcohol ethoxylates, and mixed for 20 minutes. The elevated temperature of the mixture is maintained throughout the mixing process. The dyes are added to the mixture, with mixing continuing for an additional 15 minutes. The sorbic acids, benzoic acids, urea and bisulfate are added to the mixture, which is maintained by 115-120° F., and mixture for a further 10 minutes. The sulfate is added using a TEKMAR mixer/homogenizer available from Tekmar Co. Cincinnati, Ohio while bringing the temperature up to about 120° F. to avoid premature solidification of the product. The product is vigorously mixed in a TEKMAR mixer/homogenizer for 30 minutes. The processed product is formed into solid blocks, for example by feeding into containers of appropriate size and allowed to cool.

The conventional solid rinse aid presented for comparison includes linear alcohol C12-15, 12 mole ethoxylate available under the trade name NEODOL 25-12 from Shell Chemical. The preservative is a chloromethylisothiazolin mixture available under the trade name KATHON CG-ICP.

Example 2

Stable Form Formation Assessment

In this example, a series of tests were run to compare the foam profiles of several of the raw materials (i.e. sheeting agents and defoamers) by themselves, in certain combinations with each other, and in combination with selected solid rinse aids of the present invention as well as a conventional solid rinse aid. The formulations are provided in Example 1. The foam level and foam stability was read after one minute of agitation and again after 5 minutes of agitation. This test was done at 140° F. under 6 atmospheres of pressure in a Glewwe Foam Testing Machine, with 50 ppm of active agent added, at an Ecolab Inc. facility. Stable foam was defined as foam that remains for several minutes after agitation is stopped. Partially stable foam was defined as foam that breaks slowly within a minute. Unstable foam was defined by foam that breaks rapidly (i.e., breaks in less than 15 seconds). The results of the tests are shown in Table 2.

TABLE 2

| Glewwe Foam Test | | | | | | | |
|---|---|---|---|---|---|---|---|
| | Temp | After 1 min. run time (inches) | | | After 5 min. run time (inches) | | |
| Product | ° F. | Initial | 15 sec. | 1 min | Initial | 15 sec. | 1 min. |
| Conventional solid rinse aid | 140 | 0 | 0 | 0 | 0 | 0 | 0 |
| LD-097 | 140 | 0 | 0 | 0 | 0 | 0 | 0 |
| Novel II 1012-21 | 140 | 8½ | 8 | 5½ | 9½ | 8½ | 6½ |
| D-097 | 140 | 0 | 0 | 0 | 0 | 0 | 0 |
| Pluronic 25R2 | 140 | 0 | 0 | 0 | 2 | 0 | 0 |
| Formulation C | 140 | 0 | 0 | 0 | 1 | 0 | 0 |
| Formulation D | 140 | 0 | 0 | 0 | 0 | 0 | 0 |

Example 3

Sheeting Performance

In this example, sheeting ability during warewashing of a solid rinse aid of the present invention and a conventional rinse aid are tested. The ingredients for Formulation C of the present invention and the conventional rinse aid are provided in Example 1. For the sheeting evaluation, a number of warewash materials were exposed to the rinse aid formulations during a series of 30 second cycles using 150° F.-160° F. water. The warewash materials used for the evaluation were a china dinner plate, a glass panel or slide, a 10 oz. glass tumbler, a melamine dinner plate, a stainless steel butter knife, and a stainless steel panel or slide. These warewash materials were meticulously cleaned prior to the test and then soiled with a solution containing a 0.2% hot point soil, which is a mixture of powder milk and margarine. The amount of each rinse aid formulation that was used during the wash cycles was quantified in Tables 2 and 3 as parts per million surfactant.

Immediately after the warewash materials were exposed to the rinse aid formulations, the appearance of the water draining off of the individual warewash materials (sheeting) was examined and evaluated. Tables 5-13 show the results of these tests. In Tables 2-3, the sheeting evaluation is indicated by either a dotted line ( - - - ) signifying no sheeting, the number "one" (1) signifying pin point sheeting, or a plus sign (+) signifying complete sheeting. The test was complete when all of the warewash materials were completely sheeted.

TABLE 3

| | Active Surfactant, ppm | | | | | | |
|---|---|---|---|---|---|---|---|
| | 0 | 40 | 50 | 60 | 70 | 80 | 90 |
| Sheeting Performance - Conventional Solid Rinse Aid | | | | | | | |
| China Plate | | | 1 | + | + | + | + |
| Glass Slide | | | -- | 1 | 1 | + | + |
| Glass Tumbler | | | -- | 1 | + | + | + |
| Melamine Plate | | | 1 | 1 | + | + | + |
| Stainless Steel Knife | | | -- | -- | 1 | 1 | + |
| Stainless Steel Slide | | | -- | 1 | 1 | + | + |
| Temperature, ° F. | | | 157 | 157 | 157 | 157 | 157 |
| Suds | | | | | | Trace | Trace |
| Sheeting Performance - Formulation C Solid Rinse Aid | | | | | | | |
| China Plate | | | 1 | + | + | + | + |
| Glass Slide | | | -- | 1 | 1 | 1 | + |
| Glass Tumbler | | | -- | 1 | 1 | + | + |
| Melamine Plate | | | 1 | + | + | + | + |
| Stainless Steel Knife | | | -- | -- | 1 | + | + |
| Stainless Steel Slide | | | -- | 1 | 1 | 1 | + |
| Temperature, ° F. | | | 157 | 157 | 157 | 157 | 157 |
| Suds | | | | | | Trace | Trace |

In this example, a solid rinse aid composition including the components in the weight percents listed in Table 1 was formed using an extrusion technique in lieu of TEKMAR mixing.

Example 3

Preservative Compositions of the Invention

For each use dilution, two 99-mL aliquots of test substance were dispensed in sterile 250-mL Erlenmeyer flasks, and each one was separately inoculated with 1 mL of one of the test system cocktails listed below under Method Parameters. Plate counts of each sample were taken at 7, 14, 21 and 28 days.

NOVEL II 1012-21: Alcohol Ethoxylate C10-12, 21Moles EO

LD-097: Polyoxypropylene Polyoxyethylene Block copolymer

DO97: Polyoxypropylene Polyoxyethylene Block copolymer

Abil B 9950: Dimethicone Propyl PG—Betaine, 30%

Pluronic 25-R2: Polyoxypropylene Polyoxyethylene Block copolymer

FD&C Blue #1, 34%

FD&C Yellow #5

Sorbic acid

Benzoic acid

Urea

Sodium Bisulfate, granular

Sodium Sulfate, Anhyd Fine Gran

Control 1—is a commercially available rinse aid available from Ecolab, Inc. Eagan Minnesota with kathon as a preservative Control 2—is a commercially available solid rinse aid available from Ecolab, Inc. Eagan Minnesota Method Parameters:

Test Substance:

Test One

1. Control 1 913574 pH 7.0 @10%,
2. Test Product A pH 2.0 @ 10%,

Test Two

1. Control 1 913574 @ 6% Rischmiller
2. Test Product B (a composition of the invention) with Preservative @ 10%, MFZ 17056
3. Test Product A with bisulfate alone as a preservative @ 10% Rischmiller
4. Control 3 HD @ 10% Rischmiller Preservative Test Started

| Raw Material | Control 1 | Test Product A |
|---|---|---|
| LDO97 | 64.6223 | 13.2318 |
| DO97 | 9.0000 | 5.67008 |
| Propylene Glycol | 3.0000 | |
| Neodol 25-12 | 3.0000 | |
| FD&C Blue 34% solution | 0.2724 | 0.2724 |
| FD&C Yellow | 0.0142 | 0.0142 |
| Water | 3.2941 | |
| Kathon* | 0.7370 | |
| Hydrocholric acid 31.5% | 0.0600 | |
| Urea | 16.0000 | 24.7000 |
| Sasol 1012-21GB | | 20.1091 |
| Sodium Sulfate | | 23.7285 |
| Sodium BiSulfate* | | 6.6667 |
| Abil B 9950 | | 1.2065 |
| Water | | 4.4000 |
| Total | 100.00 | 100.00 |

*These products have an 8-10% standard sump concentration used at 1-2 mls/each.

Control 1 is at two different sump concentrations; (1) is at 6% and (3) is at 10% pH7 neutral formula pH.

Control 1 uses conventional Kathon to preserve which gives kill at the desired 8-10% sump concentration.

As can be seen, Test Product A with biSulfate alone as a preservative and used to acidify to pH2 doesn't give desired kill at 10% sump.

Preservative Test Started

| Raw Material | Control 1 | Test Product B A composition of the invention | Control 2 | Control 3 |
|---|---|---|---|---|
| LDO97 | 64.6223 | 14.0793 | | |
| DO97 | 9.0000 | 5.67008 | | |
| Propylene Glycol | 3.0000 | | | |
| Neodol 25-12 | 3.0000 | | | |
| FD&C Blue 34% solution | 0.2724 | 0.2724 | | |
| FD&C Yellow | 0.0142 | 0.0142 | | |
| Water | 3.2941 | 4.4000 | | |
| Kathon | 0.7370 | | | |
| Hydrocholric acid 31.5% | 0.0600 | | | |
| Urea | 16.0000 | 24.7000 | | |
| Novel II 1012GB-21 | | 20.1091 | | |
| Sodium Sulfate | | 13.781 | | |
| Sodium BiSulfate | | 6.6667 | | |
| Abil B 9950 | | 1.2065 | | |
| Water | | 12.5000 | | |
| Sorbic Acid | | 0.5000 | 0.5000 | |
| Benzoic Acid | | 0.5000 | 0.5000 | |
| Organic Polymer Mixture | | | 47.600 | 37.600 |
| Sodium Cumene Sulfonate 93% Powder | | | 7.0000 | 13.000 |
| Alkoxylated Alcohol | | | 23.800 | 18.700 |

-continued

| Raw Material | Control 1 | Test Product B A composition of the invention | Control 2 | Control 3 |
|---|---|---|---|---|
| Citric Acid, USP, Anhydrous Gran. | | | 2.0000 | |
| FD&C Blue 1 | | | 0.0150 | 0.0150 |
| Urea, Prilled with Methylene Diurea | | | 18.5850 | 18.685 |
| Hydroxyethylidene Diphosphonic Acid, 60% | | | | 12.000 |
| Total | 100.00 | 100.00 | 100.00 | 100.0000 |

As can be seed from the foregoing table, the combination of the invention shows a synergistic affect to preserve in the same manner that the conventional preservative kathon does.

Control 1: is at two different sump concentrations; (1) is at 6% and (3) is at 10% pH7 neutral formula pH and uses conventional Kathon for kill pH7.

Test Product B acidifies pH to 2 then uses 2 pH in combination with Sorbic and Benzoic to kill at desired concentration—a composition of the invention.

Control 2 uses citric acid to acidify to pH 4-6 then Sorbic and Benzoic to kill but it has growth problems doesn't give desired kill.

Control 3 uses hydroxethylidene dipohspohonic aicd to acidify to pH 2 but has growth issues and doesn't give desired kill.

Test Systems: Bacterial Inoculum Cocktail—made up of equal parts of the 4 organisms listed:

*Staphylococcus aureus* ATCC 6538

*Escherichia coli* ATCC 11229

*Enterobacter aerogenes* ATCC 13048

*Pseudomonas aeruginosas* ATCC 15442

Yeast and Mold Inoculum Cocktail—made up of equal parts of the 6 organisms listed:

*Candida albicans* ATCC 10231

*Saccharomyces cerevisiae* ATCC 834

*Aspergillus niger* ATCC 16404

(Field isolates below were included in the yeast/mold inoculum)

White mold from Control 1 sump solution –001 Bungalow Inn, planted on Sab 05-16-06. Incubated 8 plates @ 26° C. for 8 days, harvested using 2 mL 0.85% saline/0.05% polysorbate 80 per plate with an additional 5 mL saline/polysorbate added in macerator for 8 plates' harvest, also approximately 5 mL additional 0.85% saline/0.05% polysorbate 80 was added during filtering and macerating (plate count: $1.2\times10^8$ CFU/mL).

Gray-green mold from Control 1 sump solution –003 Joe Sensor's, planted on Sab 05-16-06. Incubated 8 plates @ 26° C. for 8 days, harvested using 2 mL 0.85% saline/0.05% polysorbate 80 per plate with an additional 5 mL saline/polysorbate added in macerator for 8 plates' harvest, (plate count: $1.8\times10^8$ CFU/mL).

Pinkish orange mold from Control 1 sump solution –005 Outback, planted on Sab 05-16-06. Incubated 8 plates @ 26° C. for 8 days, harvested using 2 mL 0.85% saline/0.05% polysorbate 80 per plate with an additional 5 mL saline/polysorbate added in macerator for 8 plates' harvest (plate count: $1.2\times10^8$ CFU/mL).

Ambient (20° C. to 26° C.)

Exposure Times: 7,.14, 21 and 28 days.

Neutralizers: 9 mL Chambers (Control 1 10% Bacteria, Control 1 6% Bacteria, Control 2, and Control 3 Yeast/Mold)

99 mL Chambers (Control 1 10% Yeast/Mold, Control 1 6% Yeast/Mold, Test Product A, Test Product B, Control 3

Neutralizer screens performed as part of the testing verified that the neutralizers adequately neutralized the products and that the neutralizers were not detrimental to the tested organisms.

Subculture Media: Tryptone Glucose Extract Agar (TGE)-for bacterial enumeration

Sabouraud Dextrose Agar (Sab)-for yeast and mold enumeration

Incubation: 32° C. for 2 days (TGE)

26° C. for 3-4 days (Sab)

Part II—Results

Test Dates: 05-16-06 (Molds plated)

8 days later (Harvested field isolate molds)

9 days (Harvested field isolate molds)

20 days (Plated field isolate molds for numbers)

Inoculum Numbers (CFU/mL) Test

| Test System | A | B | C | Average |
|---|---|---|---|---|
| Bacterial Inoculum | * | * | * | * |
| Yeast/Mold Inoculum | $33\times10^4$ | $43\times10^4$ | $40\times10^4$ | $3.9\times10^5$ |

* Laboratory error: no bacterial inoculum counts were observed

Inoculum Numbers (CFU/mL)

| Test System | A | B | C | Average |
|---|---|---|---|---|
| Bacterial Inoculum | $97\times10^5$ | $50\times10^5$ | $73\times10^5$ | $7.3\times10^6$ |
| Yeast/Mold Inoculum | $14\times10^4$ | $10\times10^4$ | $16\times10^4$ | $1.3\times10^5$ |

Bacteria Results—

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| Control 1 10% pH 7 | <1 | <10 | <10 | <10 | <10 |
| Test Product A | <1 | <100 | <100 | <100 | <100 |

Bacteria Results—

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| Control 1 6% | 1 | <10 | <10 | <10 | <10 |
| Test Product B | <1 | <100 | <100 | <100 | <100 |

-continued

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| Control 2 | <1 | $3.0 \times 10^1$ | $1.0 \times 10^1$ | <10 | <10 |
| Control 3 | <1 | <100 | <100 | $9.6 \times 10^3$ | <100 |

Yeast/Mold Inoculum Results

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| Control 1 10% pH 7 | <1 | <100 | <100 | <100 | <100 |
| Test Product A | <1 | $6.0 \times 10^4$ | $6.0 \times 10^4$ | $2.0 \times 10^6$ | $1.0 \times 10^4$ |

Yeast/Mold Results

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| Control 1 6% | <1 | <100 | <100 | <100 | <100 |
| Test Product B | <1 | <100 | <100 | <100 | <100 |
| Control 2 | <1 | $1.5 \times 10^4$ (*A. niger*, yeast) | $2.0 \times 10^3$ (*A. niger*, yeast) | <10 | <10 |
| Control 3 | <1 | $1.5 \times 10^4$ (*A. niger*, and white field isolate mold) | $4.5 \times 10^2$ (*A. niger*) | $1.2 \times 10^2$ (*A. niger*) | $1.0 \times 10^1$ (*A. niger*) |

Conclusions:

Preservation criteria (following *United States Pharmacopeia* guidelines):

Bacteria: There must be no less than 2.0 log reduction from the initial inoculated count at 14 days, and no increase from the 14 days' count at 28 days.

Yeast and Mold: There must be no increase from the initial inoculated count at 14 days and 28 days.

By these USP criteria all of the test substances had preservative activity against the inoculated bacteria. All but one (Test Product A) had preservative activity against the inoculated yeasts and mold.

Example 4

The objective of the analysis was to perform preservative evaluations of Control 1 Rinse Aid and possible replacement formulations over a range of pHs.

Test Substances: 091026010-001 EXP 1 8% pH 1.85
091026010-002 EXP 1 6% pH 1.94
091026010-003 EXP 1 4% pH 2.08
091026010-004 EXP 2 8% pH 1.90
091026010-005 EXP 2 6% pH 1.97
091026010-006 EXP 2 4% pH 2.09
091026010-007 EXP 3 8% pH 2.84
091026010-008 EXP 3 6% pH 2.88
091026010-009 EXP 3 4% pH 2.94
091026010-010 EXP 4 8% pH 2.11
091026010-011 EXP 4 6% pH 2.20
091026010-012 EXP 4 4% pH 2.47
091026010-013 EXP 5 8% pH 1.84
091026010-014 EXP 5 6% pH 1.91
091026010-015 EXP 5 4% pH 2.03
091026010-016 EXP 1 no mill 8% pH 1.91
091026010-017 EXP 1 no mill 6% pH 2.00
091026010-018 EXP 1 no mill 4% pH 2.12
091026010-019 Control 2 control 8% pH 3.05
091026010-020 Control 2 control 6% pH 3.09
091026010-021 Control 2 control 4% pH 3.15

These all are testing three different acid concentrations for desired kill with varying combinations of surfactant.

| Raw Material | RM# | EXP 1 pH 2 | EXP 2 pH 2 | EXP 3 pH 4-6 | EXP 4 pH2 | EXP 5 pH 2 | Control 2 pH 4-6 |
|---|---|---|---|---|---|---|---|
| Benzoic acid | 124017 | 0.5000 | — | 0.500 | 0.500 | 0.500 | 0.500 |
| Citric acid anhydrous | 124032 | 2.000 | 2.000 | 2.000 | 2.000 | 2.000 | 2.000 |
| Sodium Bisulfate | 132027 | 7.000 | 7.00 | — | 7.000 | 7.000 | — |
| Urea prilled bag | 146001 | 11.585 | 12.585 | 18.585 | 11.585 | 18.585 | 18.585 |
| Plurafac SLF-18B45 | 170044 | 47.600 | 47.600 | — | — | — | 47.600 |
| Novel 1012GB-21 Ethoxylate | 170617 | — | — | 35.7 | 35.7 | 35.7 | — |
| Sodium cumene sulfonate | 171001 | 7.000 | 7.000 | 7.000 | 7.000 | | 7.000 |
| Pluronic 25R2 | 173336 | — | — | 35.7 | 35.7 | 35.7 | — |
| Plurafac LF-221 | 178434 | 23.800 | 23.800 | — | — | — | 23.800 |
| Sorbic Acid Food Grade | 300327 | 0.500 | — | 0.500 | 0.500 | 0.500 | 0.500 |
| FD-C Blue soln 34 | 3647880 | 0.015 | 0.015 | 0.015 | 0.015 | 0.015 | 0.015 |

Test Systems: Bacterial Inoculum Cocktail—made up of equal parts of the 5 organisms listed:

*Staphylococcus aureus* ATCC 6538

*Escherichia coli* ATCC 11229

*Enterobacter aerogenes* ATCC 13048

*Pseudomonas aeruginosa* ATCC 15442

*Burkholderia cepacia* ATCC 25416

Yeast and Mold Inoculum Cocktail—made up of equal parts of the 3 organisms listed:

*Candida albicans* ATCC 10231

*Saccharomyces cerevisiae* ATCC 834

*Aspergillus niger* ATCC 6275

Test Temperature: Ambient (20° C. to 26° C.)

Exposure Times: 7, 14, 21 and 28 days

Neutralizer: 9 mL Dey-Engley Broth

Neutralizer screens performed as part of the testing verified that the neutralizer adequately neutralized the products and that the neutralizer was not detrimental to the tested organisms.

Subculture Media: Tryptone Glucose Extract Agar (TGE) for bacterial enumeration

Sabouraud Dextrose Agar (Sab) for yeast and mold enumeration

Incubation: 32° C. for 3 days (TGE)

26° C. for 3 days (Sab)

Results:

Inoculum Numbers (CFU/mL)

| Test System | A | B | C | Average |
|---|---|---|---|---|
| Bacterial Inoculum | $51 \times 10^5$ | $53 \times 10^5$ | $79 \times 10^5$ | $6.1 \times 10^6$ |
| Yeast and Mold Inoculum | $30 \times 10^4$ | $30 \times 10^4$ | $34 \times 10^4$ | $3.1 \times 10^5$ |

Bacteria

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| EXP 1 8% | <1 | $2 \times 10^1$ | <10 | <10 | <10 |
| EXP 1 6% | <1 | <10 | <10 | <10 | <10 |
| EXP 1 4% | <1 | <10 | <10 | <10 | <10 |
| EXP 2 8% | <1 | $1 \times 10^1$ | <10 | <10 | <10 |
| EXP 2 6% | <1 | $4 \times 10^1$ | <10 | <10 | <10 |
| EXP 2 4% | <1 | <10 | <10 | <10 | <10 |
| EXP 3 8% | <1 | <10 | <10 | $1 \times 10^1$ | <10 |
| EXP 3 6% | <1 | <10 | <10 | <10 | <10 |
| EXP 3 4% | <1 | <10 | <10 | <10 | <10 |
| EXP 4 8% | <1 | <10 | <10 | <10 | <10 |
| EXP 4 6% | <1 | <10 | $1 \times 10^1$ | <10 | <10 |
| EXP 4 4% | <1 | $1 \times 10^1$ | <10 | <10 | <10 |
| EXP 5 8% | <1 | <10 | <10 | <10 | <10 |
| EXP 5 6% | <1 | <10 | <10 | <10 | <10 |
| EXP 5 4% | <1 | <10 | <10 | <10 | <10 |
| EXP 1 no mill 8% | <1 | <10 | <10 | <10 | <10 |
| EXP 1 no mill 6% | <1 | <10 | <10 | <10 | <10 |
| EXP 1 no mill 4% | <1 | <10 | <10 | $1 \times 10^1$ | <10 |
| Control 2 control 8% | <1 | <10 | <10 | <10 | <10 |
| Control 2 control 6% | <1 | <10 | <10 | <10 | <10 |
| Control 2 control 4% | <1 | <10 | <10 | <10 | <10 |

Yeast and Mold

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| EXP 1 8% | <1 | $65 \times 10^1$ | $3 \times 10^1$ | $1 \times 10^1$ | <10 |
| EXP 1 6% | <1 | $12 \times 10^3$ | $101 \times 10^1$ | $30 \times 10^1$ | $1 \times 10^1$ |
| EXP 1 4% | <1 | $29 \times 10^3$ | $55 \times 10^3$ | $25 \times 10^3$ | $10 \times 10^3$ |
| EXP 2 8% | <1 | $23 \times 10^3$ | $22 \times 10^3$ | $15 \times 10^3$ | $17 \times 10^3$ |
| EXP 2 6% | <1 | $27 \times 10^3$ | $29 \times 10^3$ | $27 \times 10^3$ | $22 \times 10^3$ |
| EXP 2 4% | <1 | $27 \times 10^3$ | $32 \times 10^3$ | $30 \times 10^3$ | $23 \times 10^3$ |
| EXP 3 8% | <1 | $28 \times 10^1$ | $5 \times 10^1$ | <10 | <10 |
| EXP 3 6% | <1 | $4 \times 10^3$ | $2 \times 10^3$ | $4 \times 10^1$ | <10 |
| EXP 3 4% | <1 | $12 \times 10^3$ | $7 \times 10^3$ | $2 \times 10^3$ | $12 \times 10^1$ |
| EXP 4 8% | <1 | <10 | <10 | <10 | <10 |
| EXP 4 6% | <1 | $11 \times 10^1$ | $2 \times 10^1$ | <10 | <10 |
| EXP 4 4% | <1 | $4 \times 10^1$ | $19 \times 10^1$ | $2 \times 10^1$ | <10 |
| EXP 5 8% | <1 | $21 \times 10^1$ | $3 \times 10^1$ | <10 | <10 |
| EXP 5 6% | <1 | $40 \times 10^1$ | $2 \times 10^1$ | <10 | <10 |
| EXP 5 4% | <1 | $5 \times 10^3$ | $19 \times 10^1$ | $2 \times 10^1$ | <10 |
| EXP 1 no mill 8% | <1 | $27 \times 10^1$ | <10 | <10 | <10 |
| EXP 1 no mill 6% | <1 | $8 \times 10^3$ | $77 \times 10^1$ | $23 \times 10^1$ | <10 |
| EXP 1 no mill 4% | <1 | $17 \times 10^3$ | $14 \times 10^3$ | $2 \times 10^3$ | $37 \times 10^1$ |
| Control 2 control 8% | <1 | $5 \times 10^3$ | $3 \times 10^1$ | $58 \times 10^1$ | $32 \times 10^1$ |
| Control 2 control 6% | <1 | $11 \times 10^3$ | $8 \times 10^3$ | $6 \times 10^3$ | $3 \times 10^3$ |
| Control 2 control 4% | <1 | $24 \times 10^3$ | $25 \times 10^3$ | $26 \times 10^3$ | $18 \times 10^3$ |

Conclusions:

Preservation criteria (following *United States Pharmacopeia* guidelines):

Bacteria: There must be no less than 2.0 log reduction from the initial inoculated count at 14 days, and no increase from the 14 days' count at 28 days.

Yeast & Mold: There must be no increase from the initial inoculated count at 14 days and 28 days.

Note: No increase is defined as not more than 0.5 log higher than previous value.

Fail: Test sample results do not meet the above criteria.

Conditional Pass: Test sample results that meet the above criteria but have bacteria or yeast & mold survivors after Day 7 of the test.

Pass: Test samples have no bacteria or yeast & mold growth after Day 7 of the test.

Bacteria:

All samples passed

Yeast and Mold:

EXP 1 no mill 8% and EXP 4 8% passed

All remaining samples conditionally passed

Contamination of products (which received a conditional pass) with environmental microorganisms of a similar type may result in growth and diminished quality. Reassessment of these formulations is advised taking into account in-use conditions.

Example 5

The objective of the analysis was to perform preservative evaluations of Solid Rinse formulations.

Test Substances: 100315006-001 4% 31049
100315006-002 6% 31049
100315006-003 4% 31677
100315006-004 6% 31677
100315006-005 4% 31594
100315006-006 6% 31594
100315006-007 4% 31953
100315006-008 6% 31953

Melt Process—Not Milled

All pH 2 using different acid combinations to preserve.

| Raw Material | RM# | 31049 | 31677 | 31594 | 31953 |
|---|---|---|---|---|---|
| WATER SOFT | 100016 | 4.440 | 4.435 | 5.194 | 5.194 |
| ALCOHOL C10-16 ETHOXYLATED | 170617 | 34.115 | 35.650 | 31.162 | 31.162 |
| FD&C BLUE SOLTN 34% FOOD GRADE | 271082 | 0.014 | 0.015 | 0.015 | 0.015 |
| MAGNESIUM SULFATE HEPTAHYDRATE | 143040 | — | 3.000 | — | 3.000 |
| UREA, PRILLED | 146001 | 17.760 | 17.750 | 25.968 | 25.968 |
| PLURONIC 25-R-2 | 173336 | 34.115 | 35.650 | 31.162 | 31.162 |
| BENZOIC ACID | 124404 | 0.478 | 0.500 | 0.500 | 0.500 |
| SORBIC ACID FD GRADE MONITOR A | 300327 | 0.478 | 0.500 | 0.500 | 0.500 |
| CITRIC ACID ANHYD TECH | 124032 | 1.911 | 2.000 | 2.000 | 2.000 |
| HYDROCHLORIC ACID 31.5% | 123034 | — | 0.500 | — | 0.500 |
| SODIUM BISULFATE GRANULAR | 132027 | 6.689 | — | 3.500 | — |

The above formulas use different acids to preserve yet none of the combinations gave the desire kill except the combination of the invention.

Test Systems: Bacterial Inoculum Cocktail -made up of equal parts of the 5 organisms listed:

*Staphylococcus* aureus ATCC 6538
*Escherichia coli* ATCC 11229
*Enterobacter aerogenes* ATCC 13048
*Pseudomonas aeruginosa* ATCC 15442
*Burkholderia cepacia* ATCC 25416

Yeast and Mold Inoculum Cocktail -made up of equal parts of the 3 organisms listed:

*Candida albicans* ATCC 10231
*Saccharomyces cerevisiae* ATCC 834
*Aspergillus niger* ATCC 16404

Test Temperature: Ambient (20° C. to 26° C.)

Exposure Times: 7, 14, 21 and 28 days

Neutralizer: 9 mL Dey Engly (D/E) Broth

Neutralizer screens performed as part of the testing verified that the neutralizer adequately neutralized the products and that the neutralizer was not detrimental to the tested organisms.

Subulture Media: Tryptone Glucose Extract Agar (TGE) for bacterial enumeration

Sabouraud Dextrose Agar (Sab) for yeast and mold enumeration

Incubation: 32° C. for 3 days (TGE)

26° C. for 3 days (Sab)

Results:

Inoculum Numbers (CFU/mL)

| Test System | A | B | C | Average |
|---|---|---|---|---|
| Bacterial Inoculum | 45 × 105 | 53 × 105 | 84 × 105 | 6.1 × 106 |
| Yeast and Mold Inoculum | 54 × 104 | 51 × 104 | 49 × 104 | 5.1 × 105 |

Bacteria

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| 100315006-001 4% 31049 | <1 | <10 | <10 | <10 | <10 |
| 100315006-002 6% 31049 | <1 | <10 | <10 | <10 | <10 |
| 100315006-003 4% 31677 | <1 | <10 | <10 | <10 | <10 |
| 100315006-004 6% 31677 | <1 | <10 | <10 | <10 | <10 |
| 100315006-005 4% 31594 | <1 | <10 | <10 | <10 | <10 |
| 100315006-006 6% 31594 | <1 | <10 | <10 | <10 | <10 |
| 100315006-007 4% 31953 | <1 | <10 | <10 | <10 | <10 |
| 100315006-008 6% 31953 | <1 | <10 | <10 | <10 | <10 |

Yeast and Mold

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| 100315006-001 4% 31049 | <1 | 1.5 × 104 | 5.1 × 102 | 1.1 × 101 | <10 |
| 100315006-002 6% 31049 | <1 | 4.0 × 102 | 7 × 101 | <10 | <10 |
| 100315006-003 4% 31677 | <1 | 6 × 105 | 5.2 × 104 | 6 × 105 | 2.5 × 105 |

-continued

| Sample Identification | Pre-Inoculum Sterility Check (CFU/mL) | Day 7 Survivors (CFU/mL) | Day 14 Survivors (CFU/mL) | Day 21 Survivors (CFU/mL) | Day 28 Survivors (CFU/mL) |
|---|---|---|---|---|---|
| 100315006-004 6% 31677 | <1 | 2.6 × 104 | 2.3 × 104 | 2.0 × 104 | 1.0 × 104 |
| 100315006-005 4% 31594 | <1 | 7 × 103 | 3.8 × 102 | 1 × 101 | <10 |
| 100315006-006 6% 31594 | <1 | 1.9 × 102 | 3 × 101 | <10 | <10 |
| 100315006-007 4% 31953 | <1 | 5 × 105 | 4.8 × 104 | 5 × 105 | 2.4 × 105 |
| 100315006-008 6% 31953 | <1 | 2.6 × 104 | 1.4 × 104 | 6 × 103 | 5.1 × 102 |

Conclusions:

Preservation criteria (following *United States Pharmacopeia* guidelines):

Bacteria: There must be no less than 2.0 log reduction from the initial inoculated count at 14 days, and no increase from the 14 days' count at 28 days.

Yeast & Mold: There must be no increase from the initial inoculated count at 14 days and 28 days.

Note: No increase is defined as not more than 0.5 log higher than previous value.

Fail: Test sample results do not meet the above criteria.

Conditional Pass: Test sample results that meet the above criteria but have bacteria or yeast & mold survivors after Day 7 of the test.

Pass: Test samples have no bacteria or yeast & mold survivors after Day 7 of the test.

4% 31049 Pass:

Bacteria Conditional Pass:

Yeast and Mold

6% 31049 Pass:

Bacteria Conditional Pass:

Yeast and Mold

4% 31677 Pass:

Bacteria Conditional Pass:

Yeast and Mold

6% 31677 Pass:

Bacteria Conditional Pass:

Yeast and Mold

4% 31594 Pass:

Bacteria Conditional Pass:

Yeast and Mold

6% 31594 Pass:

Bacteria Conditional Pass:

Yeast and Mold

4% 31953 Pas:

Bacteria Conditional Pass:

Yeast and Mold

6% 31953 Pass:

Bacteria Conditional Pass:

Yeast and Mold

Contamination of this product with environmental microorganisms of a similar type may result in growth and diminished quality. Reassessment of this formulation is advised taking into account in-use conditions

Example 6

The objective of this analysis was to determine the preservation activity of the sample submitted.

Control 2 (9825) LF221 23.8%, SLF18B45 47.6% Benzoic Acid 0.5% Citric Acid 2.0%,Sorbic Acid 0.5%, Sodium Cumeene Sulfonate 7.0%, Urea 18.595%.

Control 3 (9782) Olin SLF -18b-45 38.0%, Sodium Cumene Sulfonate 13.0%, Plurafac LF221 19.0%, Soft Water 0.5%, FD&C Blue #1.0, Dequest 2010 6.0%, Microprilled Urea 0.2% Seed 17.495%, Dequest 2010 6.0%.

Test Substances: 9782-22 1.0%

9782-22 0.5%

9782-22 5.0%

9782-22 10.0% (Sample added in week two of test)

9782-22 Control No Acid 10%

9825-4-1 10%

9825-4-2 5.0%

Test Systems: Bacterial Inoculum:

| | |
|---|---|
| *Staphylococcus aureus* | ATCC 6538 |
| *Escherichia coli* | ATCC 11229 |
| *Enterobacter aerogenes* | ATCC 13048 |
| *Pseudomonas aeruginosa* | ATCC 15442 |

Yeast and Mold Inoculum:

| | |
|---|---|
| *Candida albicans* | ATCC 18804 |
| *Saccharomyces cerevisiae* | ATCC 834 |
| *Aspergillus niger* | ATCC 16404 |

Test Temperature: Ambient Temperature (22-26° C.)

Exposure Time: 24, 48, 72 and 96 hours.

Neutralizer: Letheen 10 ml

Subculture Medium: Tryptone Glucos Extract (TGE) Agar—bacterial detection

Sabouraud Dextrose (SAB) Agar—yeast/mold detection

Incubation: 37° C. for 48 hours for TGE plates

26° C. for 4-5 days for SAB plates

Results:

Week 1 Inoculum Numbers (cfu/ml)

| Test System | A | B | C | Average |
|---|---|---|---|---|
| Bacterial Inoculum | $30 \times 10^7$ | $35 \times 10^7$ | $48 \times 10^7$ | $3.8 \times 10^8$ |
| Yeast/Mold Inoculum | $31 \times 10^3$ | $45 \times 10^3$ | $55 \times 10^3$ | $4.4 \times 10^4$ |

Week 1 Bacteria Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 0.5% 9782-22 | <10 | <10 | <10 | <10 |
| 1.0% 9782-22 | <10 | <10 | <10 | <10 |
| 5.0% 9782-22 | <10 | <10 | <10 | <10 |
| 10% 9782-22 | $7.8 \times 10^6$ | $5.9 \times 10^6$ | $1.8 \times 10^7$ | $4.8 \times 10^8$ |
| Control | | | | |
| 10% 9825-4-1 | N.A. | <10 | <10 | <10 |
| 5.0% 9825-4-2 | N.A. | <10 | <10 | <10 |

Week 1 Yeast/Mold Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 0.5% 9782-22 | <10 | $1.4 \times 10^4$ | $1.0 \times 10^4$ | $1.0 \times 10^4$ |
| 1.0% 9782-22 | <10 | $3.6 \times 10^4$ | $4.6 \times 10^4$ | $3.0 \times 10^4$ |
| 5.0% 9782-22 | $1.4 \times 10^5$ | $1.6 \times 10^3$ | $6.9 \times 10^2$ | $2.9 \times 10^2$ |
| 10% 9782-22 | $2.0 \times 10^3$ | $1.9 \times 10^5$ | $2.0 \times 10^5$ | $1.4 \times 10^5$ |
| Control | | | | |
| 10% 9825-4-1 | N.A. | $2.2 \times 10^3$ | $8.7 \times 10^2$ | $3.1 \times 10^2$ |
| 5.0% 9825-4-2 | N.A. | $1.0 \times 10^4$ | $2.3 \times 10^3$ | $1.3 \times 10^3$ |

Samples 1%, 5% and the 10% control of 9782-22 discontinued after week one due to poor results against the yeast/mold inoculum, new samples were added in the second week that contained 10% use solution (9782-22 10%).

Week 2 Inoculum Numbers (cfu/ml)

| Test System | A | B | C | Average |
|---|---|---|---|---|
| Bacterial Inoculum | $18 \times 10^6$ | $27 \times 10^6$ | $19 \times 10^6$ | $2.1 \times 10^7$ |
| Yeast/Mold Inoculum | $25 \times 10^4$ | $20 \times 10^4$ | $19 \times 10^4$ | $2.1 \times 10^5$ |

Week 2 Bacteria Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | $3.0 \times 10^1$ | <10 | <10 | <10 |
| 9782-22 10% | <10 | <10 | <10 | <10 |
| 9825-4-1 10%* | <10 | <10 | <10 | <10 |
| 9825-4-2 5.0% | <10 | <10 | <10 | <10 |

*Sample Added in Second week

Week 2 Yeast/Mold Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | $4.6 \times 10^4$ | $5.6 \times 10^4$ | $7.3 \times 10^4$ | $6.1 \times 10^4$ |
| 9782-22 10%* | $3.2 \times 10^4$ | $3.3 \times 10^4$ | $3.1 \times 10^4$ | $1.6 \times 10^4$ |
| 9825-4-1 10% | $2.6 \times 10^4$ | $1.9 \times 10^4$ | $2.0 \times 10^4$ | $1.0 \times 10^4$ |
| 9825-4-2 5.0% | $3.6 \times 10^4$ | $8.9 \times 10^4$ | $1.4 \times 10^5$ | $5.0 \times 10^5$ |

*Sample Added in Second week

Week 3 Inoculum Numbers (cfu/ml)

| Test System | A | B | C | Average |
|---|---|---|---|---|
| Bacterial Inoculum | $114 \times 10^6$ | $76 \times 10^6$ | $80 \times 10^6$ | $9.0 \times 10^7$ |
| Yeast/Mold Inoculum | $62 \times 10^5$ | $48 \times 10^5$ | $45 \times 10^5$ | $5.2 \times 10^6$ |

Week 3 Bacteria Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | $2.3 \times 10^4$ | $2.8 \times 10^2$ | <10 | <10 |
| 9782-22 10% | <10 | <10 | <10 | <10 |
| 9825-4-1 10% | <10 | <10 | <10 | <10 |
| 9825-4-2 5.0% | $4.0 \times 10^1$ | <10 | <10 | <10 |

Week 3 Yeast/Mold Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | $1.4 \times 10^5$ | $6.6 \times 10^4$ | $7.7 \times 10^4$ | $1.5 \times 10^5$ |
| 9782-22 10% | $7.0 \times 10^3$ | $8.6 \times 10^2$ | $7.1 \times 10^1$ | $1.2 \times 10^3$ |
| 9825-4-1 10% | $2.6 \times 10^4$ | $9.0 \times 10^3$ | $8.0 \times 10^3$ | $1.3 \times 10^4$ |
| 9825-4-2 5.0% | $1.0 \times 10^5$ | $1.4 \times 10^4$ | $1.8 \times 10^4$ | $6.0 \times 10^5$ |

Week 4 Inoculum Numbers (cfu/ml)

| Test System | A | B | C | Average |
|---|---|---|---|---|
| Bacterial Inoculum | $90 \times 10^7$ | $75 \times 10^7$ | $82 \times 10^7$ | $8.2 \times 10^8$ |
| Yeast/Mold Inoculum | $50 \times 10^5$ | $45 \times 10^5$ | $47 \times 10^5$ | $4.7 \times 10^6$ |

Week 4 Bacteria Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | TNTC | TNTC | TNTC | TNTC |
| 9782-22 10% | <10 | <10 | <10 | <10 |
| 9825-4-1 10% | <10 | <10 | <10 | <10 |
| 9825-4-2 5.0% | $3.0 \times 10^3$ | <10 | <10 | <10 |

Week 4 Yeast/Mold Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 0.5% | $7.8 \times 10^4$ | $1.9 \times 10^5$ | $1.1 \times 10^5$ | $9.5 \times 10^4$ |
| 9782-22 10% | $1.6 \times 10^3$ | $5.5 \times 10^2$ | $3.6 \times 10^2$ | $2.4 \times 10^2$ |
| 9825-4-1 10% | $8.6 \times 10^4$ | $1.7 \times 10^5$ | $4.0 \times 10^5$ | $4.0 \times 10^5$ |
| 9825-4-2 5.0% | $1.9 \times 10^5$ | $6.0 \times 10^5$ | $4.5 \times 10^5$ | $3.5 \times 10^4$ |

Week 5 Inoculum Numbers (cfu/ml)

| Test System | A | B | C | Average |
|---|---|---|---|---|
| Bacterial Inoculum | $51 \times 10^7$ | $61 \times 10^7$ | $57 \times 10^7$ | $5.6 \times 10^8$ |
| Yeast/Mold Inoculum | $57 \times 10^5$ | $37 \times 10^5$ | $61 \times 10^5$ | $5.2 \times 10^6$ |

Week 5 Bacteria Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 10% | <10 | <10 | <10 | <10 |

Week 5 Yeast/Mold Results

| Test Substance | Tuesday Survivors (cfu/ml) | Wednesday Survivors (cfu/ml) | Thursday Survivors (cfu/ml) | Friday Survivors (cfu/ml) |
|---|---|---|---|---|
| 9782-22 10% | $6.9 \times 10^2$ | $6.4 \times 10^2$ | $6.2 \times 10^2$ | $5.9 \times 10^2$ |

Conclusions:

Control 3 9782-22 at 0.5%, 1.0% and 5.0% provided preservative activity through week one of the analysis against the mixed bacterial inoculum, but showed no reduction against the yeast/mold inoculum samples after one week, with growth occurring in all samples. At the end of week one, concentrations of 1.0%, 5.0% and the 10% control were eliminated from testing due to poor results against the yeast/mold inoculum. The 0.5% concentration was kept to evaluate its ability to keep bacterial populations down over the four week testing period. This 0.5% sample showed preservative activity until the fourth week, where bacterial populations were then capable of growing. A additional sample 9782-22 at 10% was added in week two, this sample gave a more ideal concentration of the dispensing systems use solution. The 10% (9782-22) solution provided preservative activity throughout the four week analysis against the mixed bacterial inoculum. The yeast/mold inoculum was reduced one to two logs for the same testing period. This sample was also visibly observed over the four week testing period to evaluate the visible growth with relationship to the standard plate count numbers, no signs of yeast/mold or bacterial growth were seen throughout entire testing period.

Control 2 9825-4-1 at 5.0% and 10.0% provided preservative activity throughout the four week analysis against the mixed bacterial inoculum, but did not provide preservative activity against the yeast/mold inoculum for the same testing period The above specification, examples and data provide a description of the manufacture and use of the composition of the invention. Many solid rinse aid compositions of the invention can be made without departing from the spirit and scope of the invention, which resides in the claims hereinafter appended.

Although the foregoing invention has been described in some detail by way of illustration and example for purposes of clarity of understanding, it will be obvious that certain changes and modifications may be practiced within the scope of the appended claims. Thus, many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims.

What is claimed is:

1. A preservative composition comprising:

from about an effective amount of sodium bisulfate, to bring the composition to a pH of about 2 and a combination of acids consisting of benzoic and sorbic acids, wherein said each acid is present in an amount of from about 0.5 wt. % to about 20 wt. % with any remainder being water.

2. The preservative composition of claim 1 where said benzoic and sorbic acids are present in equal wt. %.

3. The preservative composition of claim 1 wherein said sodium bisulfate is present in an amount for from about 70 wt. % to about 95 wt. % and said acids are each present in an amount of from about 2.5 wt. % to about 15 wt. % each.

4. The preservative composition of claim 3 where said benzoic and sorbic acids are present in equal wt. %.

5. The preservative composition of claim 1 wherein said sodium bisulfate is present in an amount for from about 80 wt. % to about 90 wt. % and said acids are each present in an amount of from about 5 wt. % to about 10 wt. % each.

6. The preservative composition of claim 5 where said benzoic and sorbic acids are present in equal wt. %.

7. The preservative composition of claim 1 further comprising an anti-microbial.

8. The preservative composition of claim 1 further comprising a chelant.

9. The preservative composition of claim 1 further comprising sodium sulfate.

10. The preservative composition of claim 1 where said composition is a solid composition.

11. The preservative composition of claim 10 wherein said composition has as melt point of greater than 110° F.

12. A solid rinse aid/detergent composition comprising a preservative consisting of:

from about 60 wt. % to about 99 wt. % of sodium bisulfate, and a combination of acids consisting of benzoic and sorbic acids, wherein said each acid is present in an amount of from about 0.5 wt. % to about 20 wt. % with any remainder being water.

13. The solid composition of claim 12 wherein said solid composition includes a solid matrix comprising urea and sodium sulfate.

14. The solid composition of claim 12 wherein said composition comprises a melt point of greater than 110° F.

15. The solid composition of claim 12 wherein said sodium bisulfate is present in an amount of about 85 wt. % and said sorbic acid is present in an amount of 7.5 wt. % and said benzoic acid is present in an amount of 7.5 wt. %.

16. The solid composition of claim 12 wherein said sodium bisulfate, sorbic acid, and benzoic acid are present in a ratio of 13.34:1:1, respectively.

17. The solid composition of claim 12 wherein said composition includes a solid matrix of polyethylene glycol and urea.

18. The solid composition of claim 12 wherein said solid is a solid cast composition.

19. The solid composition of claim 12 wherein said solid is an extruded solid composition.

20. A solid rinse aid composition comprising:

sodium sulfate;

urea;

water:

a sheeting agent comprising one or more alcohol ethoxylates;

a defoamer component comprising a polymer compound including one or more ethylene oxide groups:

a preservative consisting of sodium bisulfate; sorbic acid and benzoic acid; wherein said sodium sulfate and urea are present in an amount sufficient for solidification of the rinse aid composition.

* * * * *